US008855523B2

(12) United States Patent
Udagawa

(10) Patent No.: US 8,855,523 B2
(45) Date of Patent: Oct. 7, 2014

(54) DEVELOPER-ADHESIVE BODY UNIT AND IMAGE FORMING APPARATUS

(75) Inventor: Hiroshi Udagawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 120 days.

(21) Appl. No.: 13/596,151

(22) Filed: Aug. 28, 2012

(65) Prior Publication Data

US 2013/0051839 A1 Feb. 28, 2013

(30) Foreign Application Priority Data

Aug. 30, 2011 (JP) ..... 2011-187924

(51) Int. Cl.
*G03G 15/16* (2006.01)

(52) U.S. Cl.
CPC ..... *G03G 15/161* (2013.01)
USPC ..... 399/101; 399/121; 399/123; 399/345; 399/358; 399/360

(58) Field of Classification Search
USPC ..... 399/101, 121, 123, 345, 358, 360
See application file for complete search history.

(56) References Cited

FOREIGN PATENT DOCUMENTS

| | | | |
|---|---|---|---|
| JP | 04116569 A | * | 4/1992 |
| JP | 2002-040894 A | | 2/2002 |
| JP | 2009-008904 A | | 1/2009 |

* cited by examiner

*Primary Examiner* — Ryan Walsh
(74) *Attorney, Agent, or Firm* — Panitch Schwarze Belisario & Nadel LLP

(57) ABSTRACT

A developer-adhesive body unit is detachably mounted to an image forming apparatus. The developer-adhesive body unit includes a developer-adhesive body having a surface to which a developer adheres, a cleaning member that removes the developer from the surface of the developer-adhesive body, a developer storage portion storing the removed developer, and a contact portion contacting the surface of the developer-adhesive body at an upstream side of the cleaning member in a moving direction of the surface of the developer-adhesive body. A contact-and-separation unit causes the surface of the developer-adhesive body and the contact portion to separate from each other when the developer-adhesive body unit is mounted to the image forming apparatus and the surface of the developer-adhesive body moves. The contact-and-separation unit causes the surface of the developer-adhesive body and the contact portion to contact each other when the developer-adhesive body unit is not mounted to the image forming apparatus.

14 Claims, 11 Drawing Sheets

DEVELOPER-ADHESIVE BODY UNIT AND IMAGE FORMING APPARATUS

BACKGROUND OF THE INVENTION

The present invention relates to a developer-adhesive body unit and an image forming apparatus.

There is known an electrophotographic image forming apparatus configured to convey a recording medium using an endless belt, to form a toner image on a photosensitive body, and to transfer the toner image from the photosensitive body to the recording medium conveyed by the belt. Such an image forming apparatus is disclosed in, for example, Japanese Laid-open Patent Publication No. 2009-8904.

The image forming apparatus disclosed in the above publication includes a transfer belt to which a toner adheres, a cleaning blade provided so as to contact a surface of the transfer belt, and a toner box for storing a waste toner scraped off by the cleaning blade. Further, a film is attached to the toner box so as to contact the transfer belt for preventing leakage of the waste toner from the toner box.

In this regard, there are cases where an interior of the image forming apparatus may become dirty with the toner (i.e., developer).

SUMMARY OF THE INVENTION

An aspect of the present invention is intended to prevent an interior of an image forming apparatus from becoming dirty.

According to an aspect of the present invention, there is provided a developer-adhesive body unit detachably mounted to an image forming apparatus. The developer-adhesive body unit includes a developer-adhesive body having a surface to which a developer adheres, a cleaning member that removes the developer from the surface of the developer-adhesive body, a developer storage portion for storing the developer removed by the cleaning member, a contact portion that contacts the surface of the developer-adhesive body at an upstream side of the cleaning member in a moving direction of the surface of the developer-adhesive body, and an contact-and-separation unit that causes the surface of the developer-adhesive body and the contact portion to contact each other or to separate from each other. The contact-and-separation unit causes the surface of the developer-adhesive body and the contact portion to separate from each other when the developer-adhesive body unit is mounted to the image forming apparatus and the surface of the developer-adhesive body moves. The contact-and-separation unit causes the surface of the developer-adhesive body and the contact portion to contact each other when the developer-adhesive body unit is not mounted to the image forming apparatus.

With such a configuration, an interior of the image forming apparatus is prevented from becoming dirty.

There is also provided an image forming apparatus including the developer-adhesive body unit.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, a developer-adhesive body unit and an image forming apparatus according to embodiments of the present invention will be described with reference to drawings.

Embodiment 1.

<Configuration of Printer>

Figure 1:
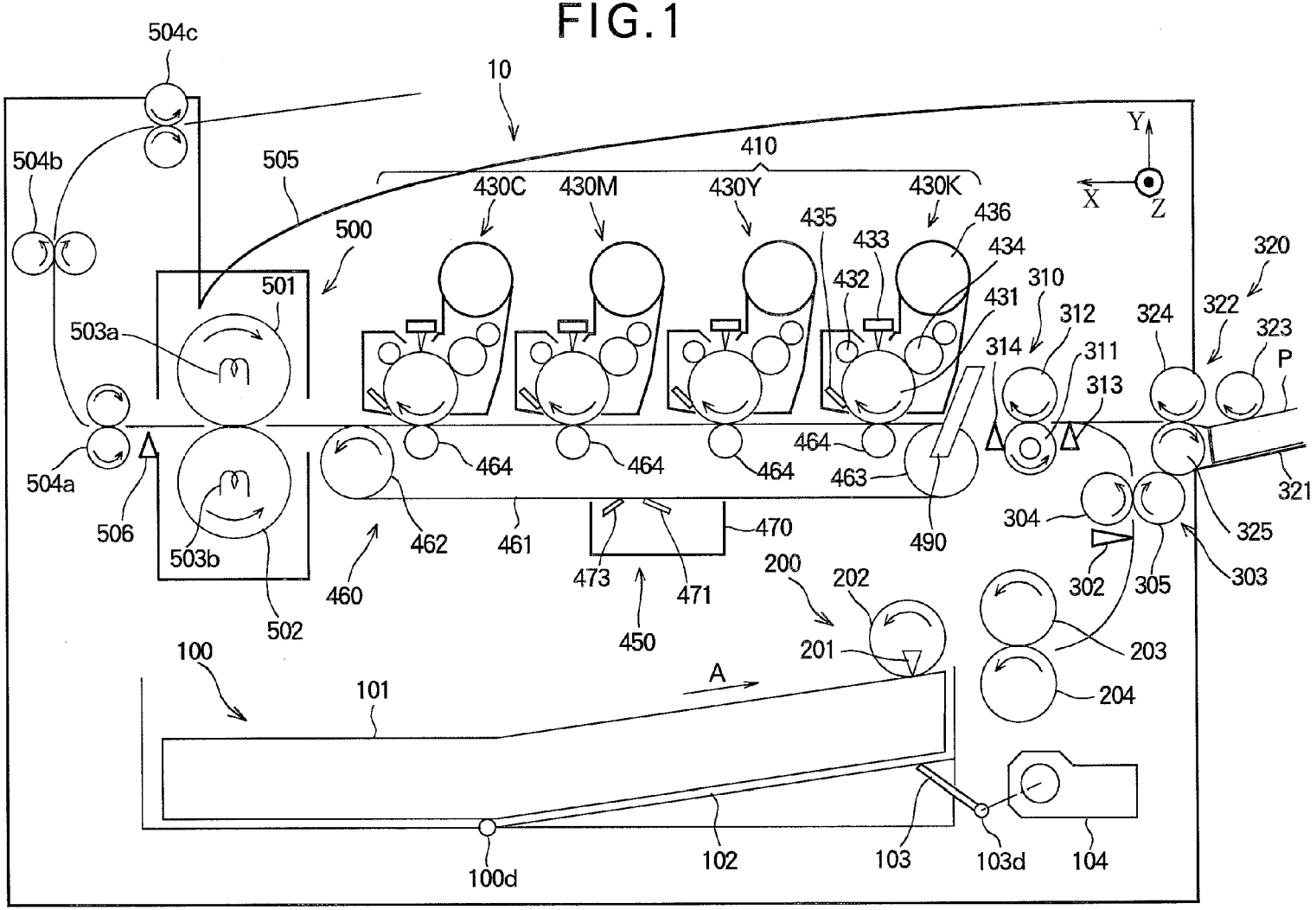
FIG. 1 is a schematic view showing a configuration of a printer to which a transfer belt unit according to Embodiment 1 of the present invention is mounted.

FIG. 1 is a schematic view showing a configuration of a printer 10 to which a transfer belt unit 450 according to Embodiment 1 is mounted. The transfer belt unit 450 is detachably mounted to the printer 10. The printer 10 is configured as an image forming apparatus that forms an image using the transfer belt unit 450. More specifically, the printer (i.e., a printing apparatus) 10 forms an image on a recording medium using electrophotographic technology, and is configured as a color printer in this embodiment. The transfer belt unit 450 has a transfer belt 461 as a developer-adhesive body (or a toner-adhesive body) having a surface to which a toner (i.e., a developer) adheres. According to a movement of the surface of the transfer belt 461, the transfer belt 461 conveys the toner adhering to the surface thereof. The transfer belt unit 450 is a developer-adhesive body unit (or a toner-adhesive body unit) detachably mounted to the printer 10.

The above described image forming apparatus can also be referred to as an "image forming apparatus main body". In such a case, an apparatus including the image forming apparatus main body and the developer-adhesive body unit can be referred to as an "image forming apparatus".

In FIG. 1, the printer 10 includes a sheet tray 100 for storing printing sheets 101 as recording media. The sheet tray 100 is detachably mounted to the printer 10. A sheet placing plate 102 is provided in the sheet tray 100, and is rotatably supported by a supporting shaft 100*d*. A stack of the printing sheets 101 is placed on the sheet placing plate 102. A lift-up lever 103 is provided at a feeding side of the sheet tray 100, and is rotatably supported by a supporting shaft 103*d*. The supporting shaft 103*d* is separably connected to a motor 104. The supporting shaft 103*d* is connected to the motor 104 when the sheet tray 100 is mounted to the printer 10. When a control unit 600 (described later) drives the motor 104, the lift-up lever 103 rotates, and an end of the lift-up lever 103 pushes a bottom of the sheet placing plate 102 upward. When the sheet placing plate 102 is pushed upward, the printing sheets 101 move upward. When the sheets 101 reaches to a predetermined height, the uppermost sheet 101 contacts the pickup roller 202, which is detected by an upward movement detecting unit 201. The control unit 600 stops a rotation of the motor 104 based on a signal from the upward movement detecting unit 201. A feed roller 203 and a retard roller 204 are provided in contact with each other. The pickup roller 202, the feed roller 203 and the retard roller 204 constitute a sheet supply unit 200 (or a medium supply unit). The pickup roller 202 and the feed roller 203 are driven by a feed motor 711 to rotate in directions shown by arrows. The retard roller 204 is applied with a torque in a direction shown by an arrow by a torque generation unit (not shown). With such an arrangement, the pickup roller 202 draws out the uppermost printing sheet 101 in a direction shown by an arrow A from the sheet tray 100. The feed roller 203 and the retard roller 204 feed the printing sheets 101 (drawn out by the pickup roller 204) one by one while preventing a plurality of the printing sheets 101 from being drawn out at the same time.

At a downstream side of the sheet supply unit 200 in a conveying direction of the printing sheet 101, a sheet sensor 302, a pair of conveying rollers 303, a sheet sensor 313, a pair of conveying rollers 310, and a writing sensor 314 are arranged in this order. The conveying rollers 303 correct a skew of the printing sheet 101. The sheet sensor 313 is used to detect a timing at which the conveying rollers 310 start rotation. The conveying rollers 310 convey the printing sheet 101 to an image forming unit 410. The writing sensor 314 is used to determine a timing to start exposure (writing) in the image forming unit 410. The conveying rollers 303 include a driving roller 304 and a driven roller 305. The conveying rollers 310 include a driving roller 311 and a driven roller 312. The driving rollers 304 and 311 are driven by the feed motor 711 via a transmission mechanism (not shown). Rotations of the driving rollers 304 and 311 are controlled by a conveying control unit (not shown).

The printer 10 of this embodiment has a multi-purpose tray (MPT) 320. The MPT 320 is mounted to a side surface portion of the printer 10 so that the MPT 320 is openable. The MPT 320 has a sheet placing plate 321 rotatably supported by a supporting shaft (not shown). A stack of printing sheets P is placed on the sheet placing plate 321. The sheet placing plate 321 is pressed upward by a spring (not shown) from a bottom, and the stack of the printing sheets P on the sheet placing plate 321 moves upward and contacts a pickup roller 323. An MPT roller 324 and a retard roller 325 are provided in contact with each other. The pickup roller 323, the MPT roller 324 and the retard roller 325 constitute an MPT sheet supply unit 322. The pickup roller 323 and the MPT roller 324 are driven by the feed motor 711 to rotate in directions respectively shown by arrows. The retard roller 325 is applied with a torque in a direction shown by an arrow by a torque generation unit (not shown). The pickup roller 323 draws out the uppermost printing sheet P from the MPT 320. The MPT roller 324 and the retard roller 325 feed the printing sheets P (drawn out by the pickup roller 323) one by one while preventing a plurality of the printing sheets P from being drawn out at the same time.

The printer 10 includes an image forming unit 410 for forming images of four colors. The image forming unit 410 includes process units 430K, 430Y, 430M and 430C respectively forming images of black (K), yellow (Y), magenta (M) and cyan (C). The process units 430K, 430Y, 430M and 430C are arranged in this order from an upstream side along a conveying direction of the printing sheet 101 or P (hereinafter, referred to as a sheet-conveying direction or a medium-conveying direction). The process units 430K, 430Y, 430M and 430C are detachably mounted to a frame of the printer 10. Next, a configuration of the process unit 430K will be described.

The process unit 430K includes a photosensitive drum 431 as an image bearing body provided so as to be rotatable in a direction shown by an arrow. Around the photosensitive drum 431, a charging roller 432 (i.e., a charging member), an exposure device 433, a developing roller 434 (i.e., a developer bearing body), and a cleaning blade 435 (i.e., a cleaning member) are arranged in this order from an upstream side along a rotational direction of the photosensitive drum 431. The charging roller 432 applies electrical charge to a surface of the photosensitive drum 431 to thereby uniformly charge the surface of the photosensitive drum 431. The exposure device 433 emits light to selectively expose the charged surface of the photosensitive drum 431 to thereby form a latent image. The developing roller 434 causes a black toner to adhere to the surface of the photosensitive drum 431 on which the latent image is formed, so as to develop the latent image. The cleaning blade 435 removes a residual (non-transferred) toner remaining on the surface of the photosensitive drum 431. The process unit 430 further includes a toner storage unit 436 as a developer storage unit that stores a toner to be supplied to the developing roller 434. Since the process units 430Y, 430M and 430C have the same configurations as the process unit 430K, and therefore descriptions of the process units 430Y, 430M and 430C will be omitted.

The printer 10 includes a transfer belt unit 450 for transferring the toner images formed by the process units 430K, 430Y, 430M and 430C to the printing sheet 101 or P. The transfer belt unit 450 holds and conveys the printing sheet 101 or P conveyed from the conveying rollers 310. After the toner image is transferred to the printing sheet 101 or P, the transfer belt unit 450 conveys the printing sheet 101 or P to a downstream side of the transfer belt unit 450. Detailed description of the transfer belt unit 450 will be made later.

A fixing unit 500 is provided at a downstream side of the image forming unit 410 in the sheet-conveying direction. The fixing unit 500 is configured to fix the toner image to the printing sheet 101 or P. More specifically, the fixing unit 500 includes a pair of rollers: an upper roller 501 and a lower roller 502. The upper roller 501 has a halogen lamp 503*a* as an internal heat source and a surface layer formed of a resilient body. The lower roller 502 has a halogen lamp 503*b* as an internal heat source and a surface layer formed of a resilient body. The upper roller 501 and the lower roller 502 apply heat and pressure to the toner image on the printing sheet 101 or P conveyed from the image forming unit 410 so as to melt the toner image and fix the toner image to the printing sheet 101 or P. Ejection rollers 504*a*, 504*b* and 504*c* are provided at a downstream side of the fixing unit 500 in the sheet-conveying direction. The ejection rollers 504*a*, 504*b* and 504*c* convey the printing sheet 101 or P having passed through the fixing unit 500, and eject the printing sheet 101 or P to a stacker portion 505 provided outside the printer 10. An ejection sensor 506 is provided between the fixing unit 500 and the ejection roller 504*a*. The ejection sensor 506 detects the printing sheet 101 or P.

The respective rollers and drums of the printer 10 are rotated by power transmitted from driving sources via gears (not shown). Hereinafter, "the printing sheet 101 or P" will be simply referred to as "the printing sheet 101".

[Configuration of Transfer Belt Unit]

Figure 2:
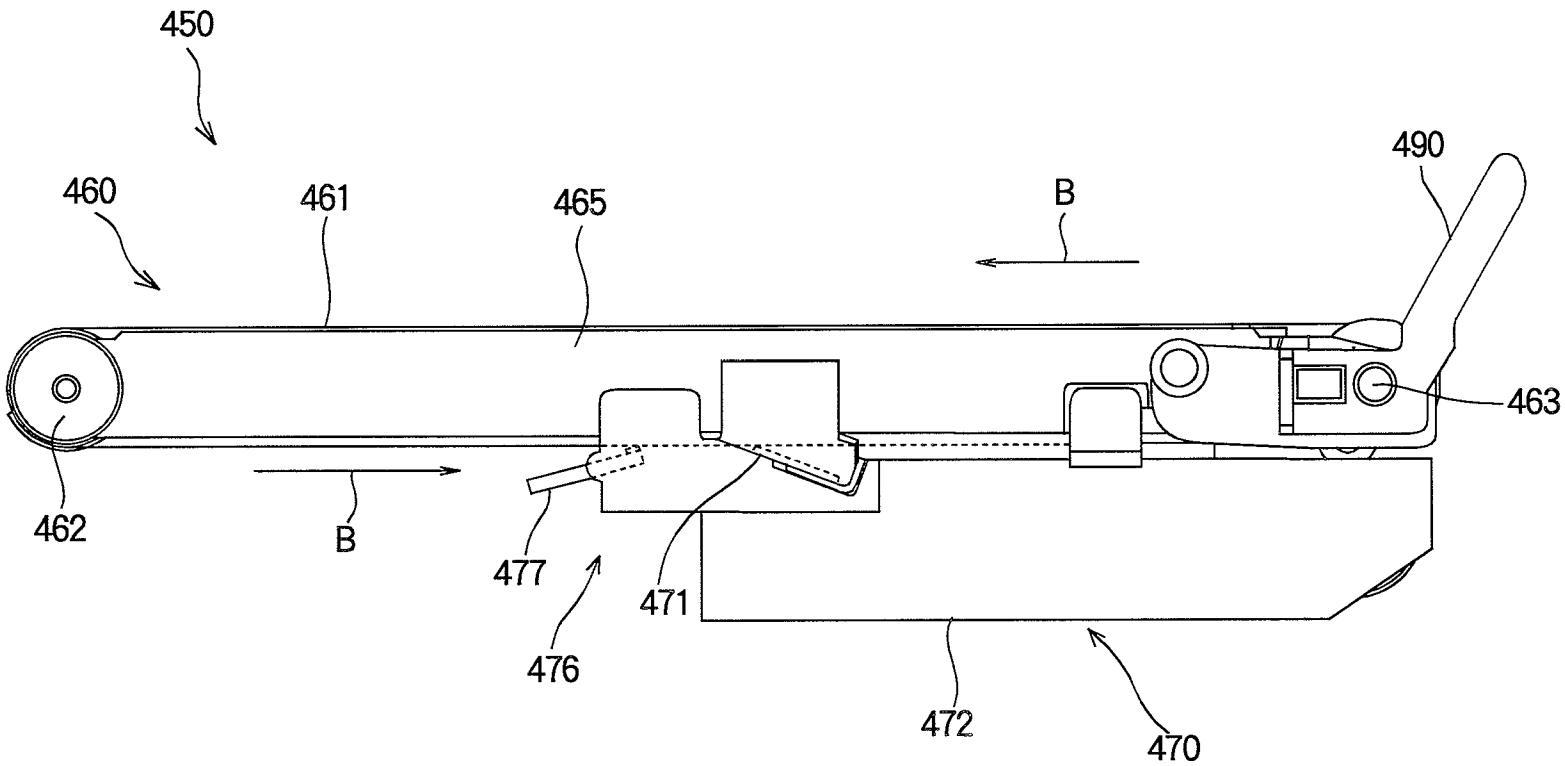
FIG. 2 is a side view showing a configuration of the transfer belt unit according to Embodiment 1.
Figure 3:
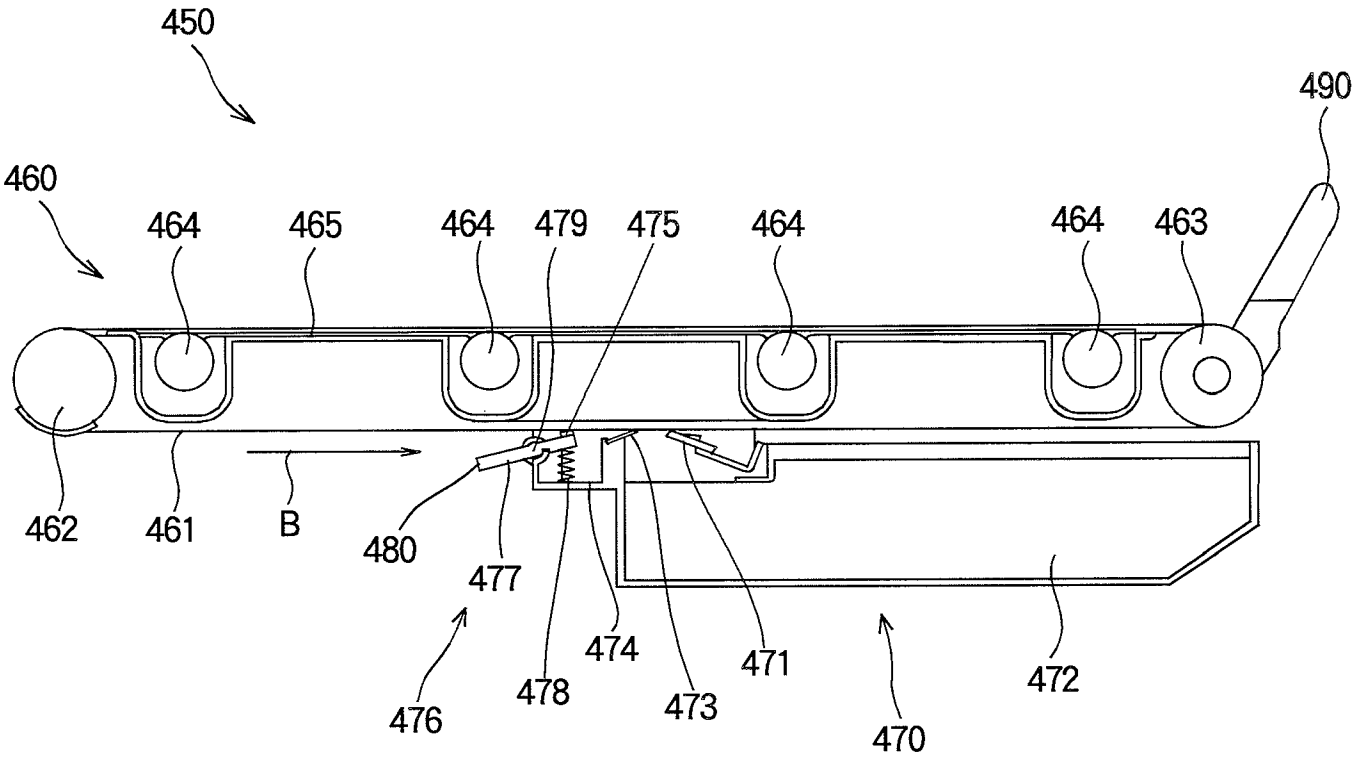
FIG. 3 is a sectional view showing the configuration of the transfer belt unit according to Embodiment 1.
Figure 4:
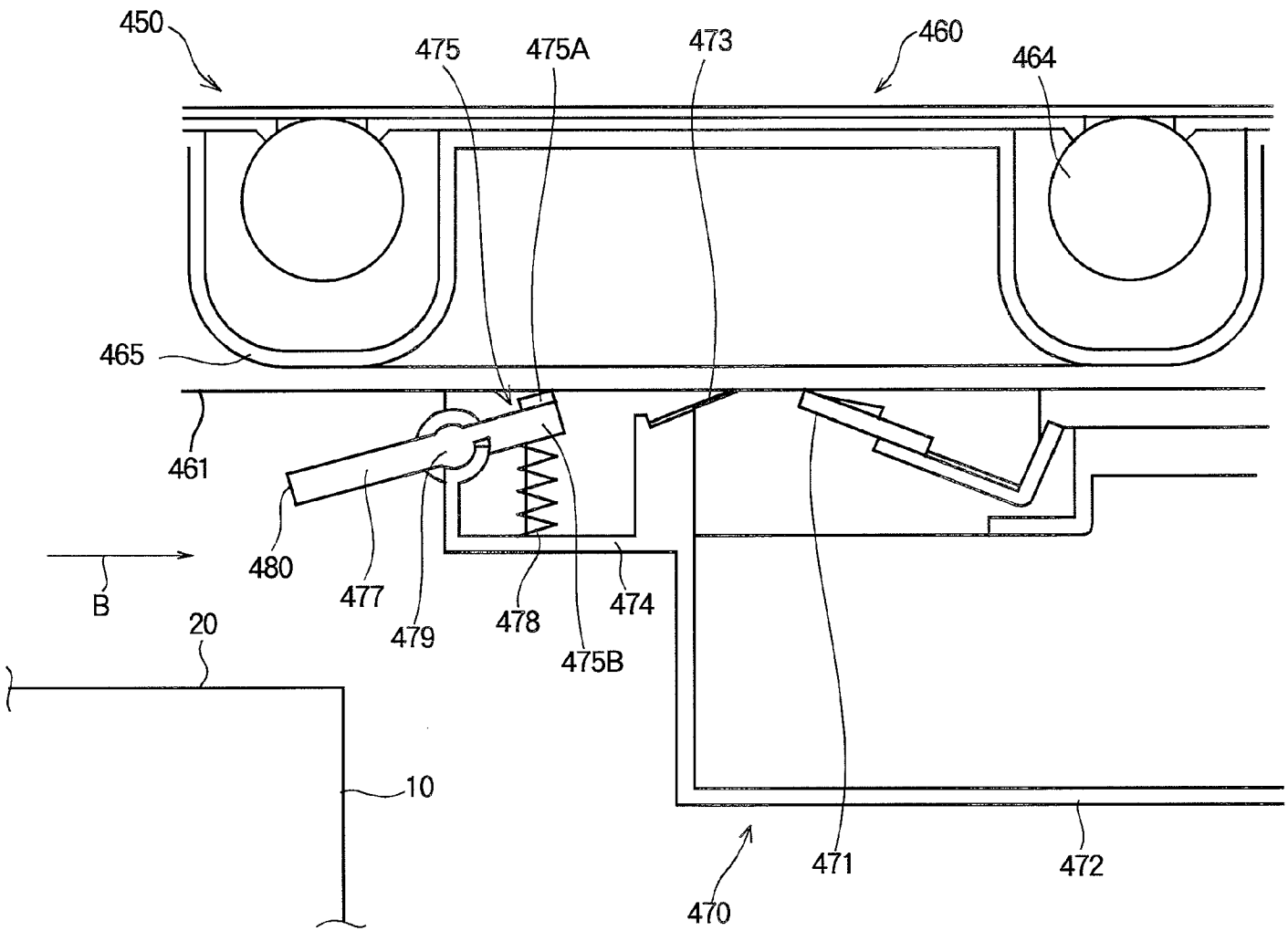
FIG. 4 is an enlarged sectional view showing a part of the transfer belt unit according to Embodiment 1.

A configuration of the transfer belt unit 450 (i.e., the developer-adhesive body unit) according to Embodiment 1 will be described. FIGS. 2 and 3 are respectively a side view and a sectional view showing a configuration of the transfer belt unit 450 according to Embodiment 1. FIG. 4 is an enlarged sectional view showing a part of the transfer belt unit 450. In FIGS. 2 through 4, the transfer belt unit 450 is shown in a state where the transfer belt unit 450 is taken out from the printer 10.

As shown in FIGS. 1 through 4, the transfer belt unit 450 includes a belt driving unit 460 and a waste toner collection unit 470.

The belt driving unit 460 includes a transfer belt 461, a driving roller 462, a tension roller 463, transfer rollers 464, and a belt frame 465. The transfer belt 461 is in the form of an endless belt, and is configured to electrostatically absorb and convey the printing sheet 101 conveyed from the conveying rollers 310. The transfer belt 461 is stretched around the driving roller 462 and the tension roller 463. The driving roller 462 causes the transfer belt 461 to rotate so that a surface of the transfer belt 461 moves in a predetermined moving direction (hereinafter, referred to as a belt-moving direction). The belt-moving direction is shown by an arrow B in FIGS. 2 through 4, and is also referred to as a belt running direction of a belt driving direction. In an example shown in FIGS. 1-4, the belt-moving direction is oriented from the right to the left on the process unit side (i.e., an upper side), and is oriented from the left to the right on the waste toner collection unit side (i.e., a lower side). The driving roller 462 is driven by a power transferred from a driving source (i.e., a belt motor 609 shown in FIG. 5) via a transmission mechanism. The transfer rollers 464 are provided so as to correspond to the process units 430K, 430Y, 430M and 430C. The transfer rollers 464 are pressed against the photosensitive drums 431 of the corresponding process units via the transfer belt 461. The transfer rollers 464 are made of rubber rollers having electrical conductivity. Each transfer roller 464 is applied with an electric potential so as to form a difference between a surface potential of the photosensitive drum 431 and a surface potential of the transfer roller 464 when transferring the toner image from the photosensitive drum 431 to the printing sheet 101. The belt frame 465 is a frame body that supports the transfer belt 461, the driving roller 462, the tension roller 463 and the transfer rollers 464. More specifically, the belt frame 465 has a shape extending in the sheet-conveying direction. The driving roller 462 and the tension roller 463 are located on both ends of the belt frame 465 in the sheet-conveying direction. Further, the four transfer rollers 464 are provided between the driving roller 462 and the tension roller 463.

The waste toner collection unit 470 (i.e., a waste developer collection unit) is configured to collect the toner adhering to the transfer belt 461. More specifically, the waste toner collection unit 470 is a cleaning apparatus configured to remove the toner from the surface of the transfer belt 461, and to store the toner (i.e., a waste toner) removed from the surface of the transfer belt 461. The waste toner collection unit 470 includes a cleaning blade 471, a toner box 472, a film 473, a pan 474, a contact portion 475 and a contact-and-separation mechanism 476 as a contact-and-separation unit.

The cleaning blade 471 is a cleaning member configured to scrapes off the toner adhering to the surface of the transfer belt 461 to thereby clean the transfer belt 461. The toner box 472 (i.e., a toner storage portion or a developer storage portion) is configured to store the toner scraped off by the cleaning blade 471.

The film 473 is a seal member that contacts the surface of the transfer belt 461 at an upstream side of the cleaning blade 471 and the toner box 472 in the belt-moving direction, so as to prevent scattering of the toner removed by the cleaning blade 471. More specifically, the film 473 is provided so as to seal a gap between the toner box 472 and the transfer belt 461 to thereby prevent scattering of the toner (scraped off by the cleaning blade 471) outside the toner box 472. The pan 474 is a toner holding portion (or a developer holding portion) provided at an upstream side of the film 473 in the belt-moving direction, and is configured to hold or collect the toner scraped off from the transfer belt 461 by the film 473.

The contact portion 475 is a toner leakage preventing portion (or a developer leakage preventing portion) provided so as to be contactable with and separable from the surface of the transfer belt 461. The contact portion 475 contacts the transfer belt 461 at an upstream side of the film 473 and the pan 474 in the belt-moving direction, and prevents leakage of the toner stored in the toner box 472 and the toner held in the pan 474. More specifically, the contact portion 475 contacts the transfer belt 461 so as to seal a gap between the pan 474 and the transfer belt 461.

The contact-and-separation mechanism 476 causes the surface of the transfer belt 461 and the contact portion 475 to contact each other or separate from each other. That is, in a state where the transfer belt unit 450 is mounted to the printer 10 and the surface of the transfer belt 461 moves, the contact-and-separation mechanism 476 causes the surface of the transfer belt 461 and the contact portion 475 to be apart from each other. In a state where the transfer belt unit 450 is not mounted to the printer 10, the contact-and-separation mechanism 476 causes the surface of the transfer belt 461 and the contact portion 475 to contact each other.

In a preferred embodiment, the contact-and-separation mechanism 476 causes the transfer belt 461 and the contact portion 475 to separate from each other when the transfer belt unit 450 is mounted to the printer 10, and causes the transfer belt 461 and the contact portion 475 to contact each other when the transfer belt unit 450 is detached from the printer 10. That is, the contact-and-separation mechanism 476 causes the transfer belt 461 and the contact portion 475 to separate from each other and to contact each other in response to mounting and detaching of the transfer belt unit 450 with respect to the printer 10.

More specifically, when the transfer belt unit 450 is mounted to the printer 10, the transfer belt unit 450 is pushed by the printer 10 and is applied with a force by the printer 10. With this force, the contact-and-separation mechanism 476 shifts from a first state where the surface of the transfer belt 461 and the contact portion 475 contact each other to a second state where the surface of the transfer belt 461 and the contact portion 475 are apart from each other. When the transfer belt unit 450 is detached from the printer 10, the transfer belt unit 450 is released from the force applied by the printer 10, and therefore the contact-and-separation mechanism 476 returns from the second state to the first state.

In this embodiment, the contact-and-separation mechanism 476 includes a lever 477 as a supporting member for supporting the contact portion 475, and a spring 478 as a resilient member for biasing the lever 477. When the transfer belt unit 450 is mounted to the printer 10, the lever 477 is pushed by the printer 10 and is applied with a force by the printer 10. With this force, the lever 477 moves from a first position (FIGS. 2 to 4) where the contact portion 475 contacts the surface of the transfer belt 461 to a second position where the contact portion 475 separates from the surface of the transfer belt 461. A movement of the lever 477 from the first position to the second position causes the spring 478 to resiliently deform. When the transfer belt unit 450 is detached from the printer 10, the lever 477 is released from the force applied by the printer 10, and therefore the lever 477 returns from the second position to the first position by a resilient restoring force generated by the spring 478 when recovering its original shape.

More specifically, the lever 477 is provided at an upstream side of the film 473 in the belt-moving direction. The lever 477 has a shape elongated in the belt-moving direction. The contact portion 475 is provided at a downstream end portion of the lever 477 in the belt-moving direction. The lever 477 is rotatably supported by a rotation shaft 479 between both ends of the lever 477 in the belt-moving direction. The rotation shaft 479 is parallel to a surface of the transfer belt 461, and is perpendicular to the belt-moving direction. Further, the rotation shaft 479 is provided at an upstream side of the pan 474 in the belt-moving direction. The pan 474 is provided between the rotation shaft 479 and the film 473. The lever 477 is biased by the spring 478 so that the lever 477 rotates about the rotation shaft 479 in a direction in which the contact portion 475 contacts the transfer belt 461. More specifically, the spring 478 biases the downstream end portion of the lever 477 in the belt-moving, direction toward the transfer belt 461. The downstream end portion of the lever 477 in the belt-moving direction constitutes a lever actuation end 480 that receives a force (i.e., an actuation force) for moving the contact portion 475. In this example, the printer 10 has a lever pushing portion 20 as an actuation force imparting portion. The lever pushing portion 20 applies the actuation force to the transfer belt unit 450 for causing the surface of the transfer belt 461 and the contact portion 475 to contact each other or separate from each other. The lever actuation end 480 receives the actuation force by the lever pushing portion 20.

In a preferred embodiment, the contact portion 475 has a closely-contacting member that closely contacts the surface of the transfer belt 461 in order to enhance sealing property. In this example, as shown in FIG. 4, the contact portion 475 has a sponge portion 475A (i.e., a resilient member) as the closely-contacting member that contacts the surface of the transfer belt 461 while the sponge portion 475A resiliently deforms. The sponge portion 475A is provided on a base portion 475B constituted by the downstream end portion of the lever 477 in the belt-moving direction. The sponge portion 475A and the base portion 475B constitute the contact portion 475.

Seal members (for example, sponges) are provided on both ends of the toner box 472 in a direction (i.e., an axial direction of the rotation shaft 479) parallel to the surface of the transfer belt 461 and perpendicular to the belt-moving direction. The seal members seal a gap between the toner box 472 and the transfer belt 461 so as to prevent leakage of the waste toner via the both ends. Similarly, seal members (for example, sponges) are provided on both ends of the pan 474. The seal members seal a gap between the pan 474 and the transfer belt 461 so as to prevent leakage of the waste toner via the both ends.

The transfer belt unit 450 further includes a handle portion 490 gripped by a user when the transfer belt unit 450 is mounted to or detached from the printer 10. More specifically, the handle portion 490 is provided on an upstream end portion of the transfer belt unit 450 in the sheet-conveying direction. The handle portion 490 is mounted to, for example, the belt frame 465.

In FIG. 1, an X-axis is defined as the conveying direction of the printing sheet 101 on the transfer belt 461. A Y-axis is defined in a direction of a normal line of the surface of the transfer belt 461 conveying the printing sheet 101. A Z-axis is defined as a direction perpendicular to both of the X-axis and the Y-axis.

[Control System of Printer]

Figure 5:
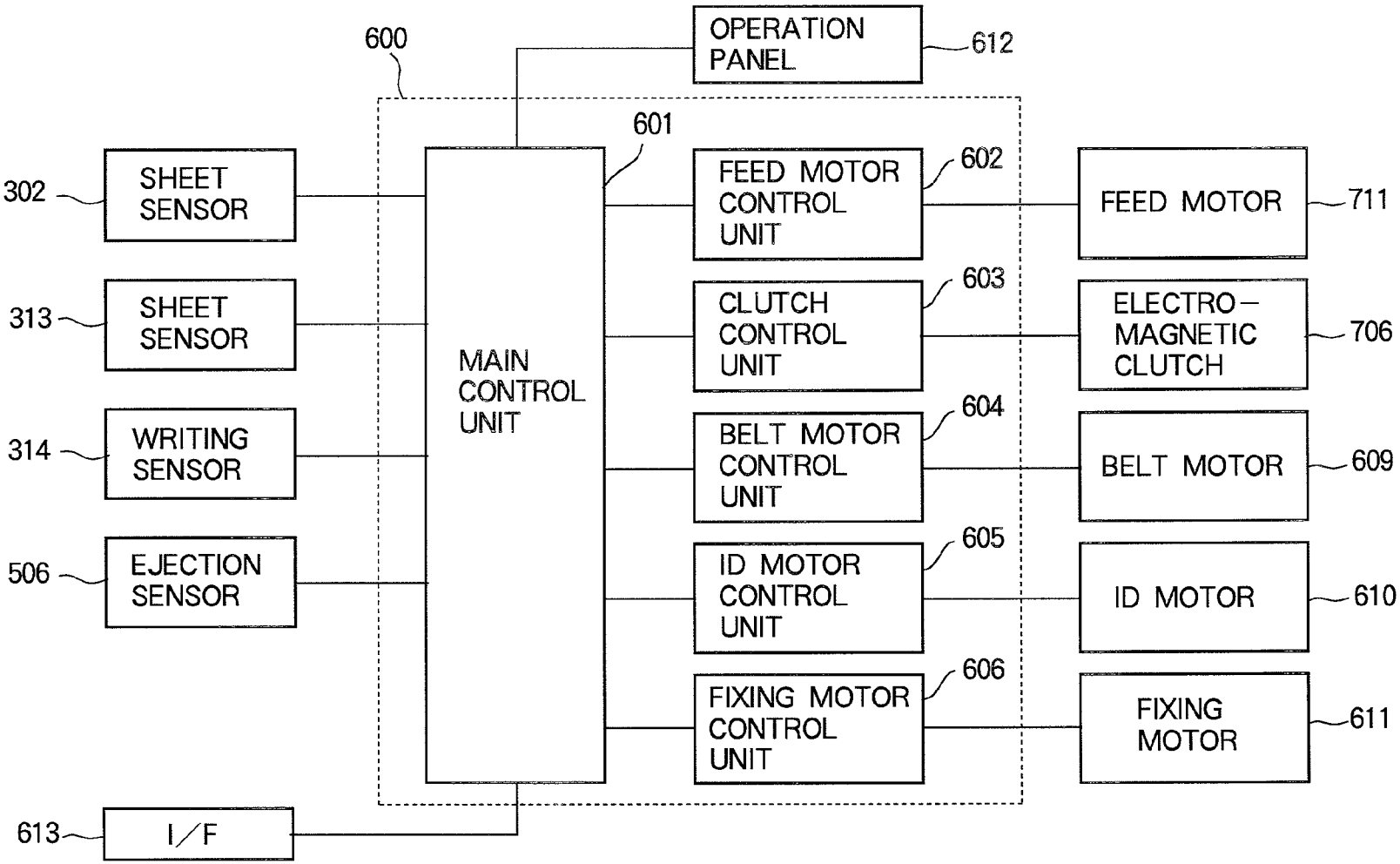
FIG. 5 is a block diagram showing a control system of the printer according to Embodiment 1.

A control system of the printer 10 will be described. FIG. 5 is a block diagram showing a configuration of the control system of the printer 10 according to Embodiment 1.

In FIG. 5, the printer 10 includes a control unit 600 for controlling an operation of the printer 10. The control unit 600 includes a main control unit 601 as a control center. The main control unit 601 includes a CPU (Central Processing Unit) composed of a control part, a calculation part and the like, a RAM (Random Access Memory) and a ROM (Read Only Memory) for storing programs or the like, a timer counter or the like. The main control unit 601 controls respective units of the printer 10 based on detection signals inputted by the sheet sensor 302, the sheet sensor 313, the writing sensor 314 and the ejection sensor 506 via input ports. The main control unit 601 is connected to a feed motor control unit 602, a clutch control unit 603, a belt motor control unit 604, an ID motor control unit 605 and a fixing motor control unit 606. The feed motor control unit 602 sends operation signal to the feed motor 711 to control an operation of the feed motor 711. The clutch control unit 603 sends operation signal to an electromagnetic clutch 706 to control an operation of the electromagnetic clutch 706. The belt motor control unit 604 sends operation signal to a belt motor 609 to control an operation of the belt motor 609. The ID (Image Drum) motor control unit 605 sends operation signal to an ID motor 610 to control an operation of the ID motor 610. The fixing motor control unit 606 sends operation signal to a fixing motor 611 to control an operation of the fixing motor 611.

A two-phase excitation motor, a DC (Direct Current) motor or the like is used as each of these motors. When the two-phase excitation motor is used, acceleration or deceleration of the rotation of the motor is controlled by supplying a constant current to the motor and switching a phase current direction at a leading edge of a clock signal or changing a clock frequency. When the DC motor is used, a rotation speed is controlled by a magnitude of voltage applied between motor terminals, and a rotating direction is controlled by switching polarity of the voltage applied between the motor terminals. A dry single-plate type electromagnetic clutch or the like is used as the electromagnetic clutch 706. The electromagnetic clutch is constituted by a field-rotor assembly and an armature assembly. The field-rotor assembly includes a rotor and a field (having an internal coil) integrated with each other and supported via ball bearings. The field-rotor assembly is mounted to a rotation member such as a shaft connected to a driving source. The armature assembly is disposed so that a small gap is formed between the armature assembly and the rotor, and is fixed to a member such as a pulley or gear using a fixing bolt via a plate spring. When a current flows through the coil in the electromagnetic clutch, magnetic flux is generated between the field-rotor assembly and the armature assembly, so that the armature is attracted by the rotor, i.e., the electromagnetic clutch is engaged. When the electromagnetic clutch is engaged, a power of the driving source is transmitted via the electromagnetic clutch to the pulley or gear, and is transmitted to the driving roller or the like. While the application of current to the coil continues, the armature is kept being attracted by the rotor. When the current stops, the magnetic flux disappears, and the armature separates from the rotor and returns to its original position by the force of the plate spring.

The printer 10 includes an operation panel 612. The operation panel 612 includes an input unit constituted by a switch or the like, and a display unit constituted by an LED (Light Emitting Diode) or LCD (Liquid Crystal Display). A user can provide instruction to the printer 10 by operating the input unit of the operation panel 612. For example, the user can perform various kinds of settings such as choice of font, choice of sheet size or the like. The display unit displays various kinds of information such as conditions set by the input unit. The printer 10 includes an interface unit (I/F) 613. The interface unit 613 includes an interface connector, an interface IC (Integrated Circuit) or the like. The interface unit 613 receives printing data from a host computer (not shown), and transfers the printing data to the main control unit 601.

[Operation of Printer]

An operation of the printer 10 having the above described configuration will be described with reference to FIG. 1.

First, description will be made of a case where the printing sheets 101 are supplied by the sheet tray 100. In this case, the printing sheets 101 stored in the sheet tray 100 are fed into a sheet conveying path one by one (starting from the uppermost printing sheet 101 of the stack) by the sheet supply unit 200 including the pickup roller 202, the feed roller 203 and the retard roller 204. The printing sheet 101 passes the sheet sensor 302, and reaches the conveying rollers 303. The conveying rollers 303 start conveying the printing sheet 101 at a predetermined timing based on a timing at which the printing sheet 101 passes the sheet sensor 302. In this state, the printing sheet 101 is conveyed by a predetermined amount by the sheet supply unit 200 after a leading end of the printing sheet 101 reaches the conveying rollers 303. Therefore, the leading end of the printing sheet 101 is pushed into a nip portion between the conveying rollers 303, and a skew of the printing sheet 101 is corrected. Thereafter, the printing sheet 101 is nipped between the conveying rollers 303, and conveyed by the conveying rollers 303 (i.e., the driving roller 304 and the driven roller 305) in the sheet-conveying direction.

The printing sheet 101 conveyed by the conveying rollers 303 passes the sheet sensor 313, and reaches the conveying rollers 310. The conveying rollers 310 start rotation when the printing sheet 101 passes the sheet sensor 302, and convey the printing sheet 101 without stopping the printing sheet 101. The printing sheet 101 conveyed by the conveying rollers 310 passes the writing sensor 314, and reaches the image forming unit 410.

When the printing sheet 101 reaches the image forming unit 410, the printing sheet 101 is held and conveyed by the transfer belt 461. The printing sheet 101 conveyed by the transfer belt 461 reaches between the photosensitive drum 431 of the process unit 430K and the transfer roller 464. When the printing sheet 101 passes between the photosensitive drum 431 and the transfer roller 464, the toner image is transferred from the photosensitive drum 431 to the surface (i.e., a recording surface) of the printing sheet 101.

Then, the printing sheet 101 passes the process units 430Y, 430M and 430C, and the toner images of the respective colors are transferred from the photosensitive drums 431 to the recording surface of the printing sheet 101 in an overlapping manner. Then, the printing sheet 101 is conveyed to the fixing unit 500, and the toner image is fixed to the recording surface of the printing sheet 101. Thereafter, the printing sheet 101 to which the toner image is fixed is ejected by the ejection rollers 504*a*, 504*b* and 504*c*, and is placed on the stacker portion 505. In this way, a color image is formed on the printing sheet 101.

Next, description will be made of a case where the printing sheets P are supplied by the MPT 320. In this case, the printing sheets P stored in the MPT 320 are fed into the sheet conveying path one by one (starting from the uppermost printing sheet P of the stack) by the MPT sheet supply unit 322 including the pickup roller 323, the MPT roller 324 and the retard roller 325. The printing sheet P passes the sheet sensor 313, and reaches the conveying rollers 310. The conveying rollers 310 start conveying the printing sheet P at a predetermined timing based on a timing at which the printing sheet P passes the sheet sensor 313. In this state, the printing sheet P is conveyed by a predetermined amount by the MPT sheet supply unit 322 after a leading end of the printing sheet P reaches the conveying rollers 310. Therefore, the leading end of the printing sheet P is pushed into a nip portion between the conveying rollers 310, and a skew of the printing sheet P is corrected. Thereafter, the printing sheet P is nipped between the conveying rollers 310, and conveyed by the conveying rollers 310 (i.e. the driving roller 311 and the driven roller 312) in the sheet-conveying direction. The printing sheet P conveyed by the conveying rollers 310 passes the writing sensor 314, and reaches the image forming unit 410. Thereafter, the printing sheet P passes the image forming unit 410 and the fixing unit 500, and is ejected to the stacker portion 505 in a similar manner to the printing sheet 101 supplied from the sheet tray 100.

In the above described mechanism for conveying the printing sheet 101 or P (i.e., a conveying mechanism), the feed roller 203, the conveying rollers 303, the conveying rollers 310 and the MPT roller 324 are connected to driving sources via the electromagnetic clutches (not shown) mounted to respective roller shafts, and receive driving forces from the driving sources.

[Operation for Mounting and Detaching Transfer Belt Unit]

Figure 6:
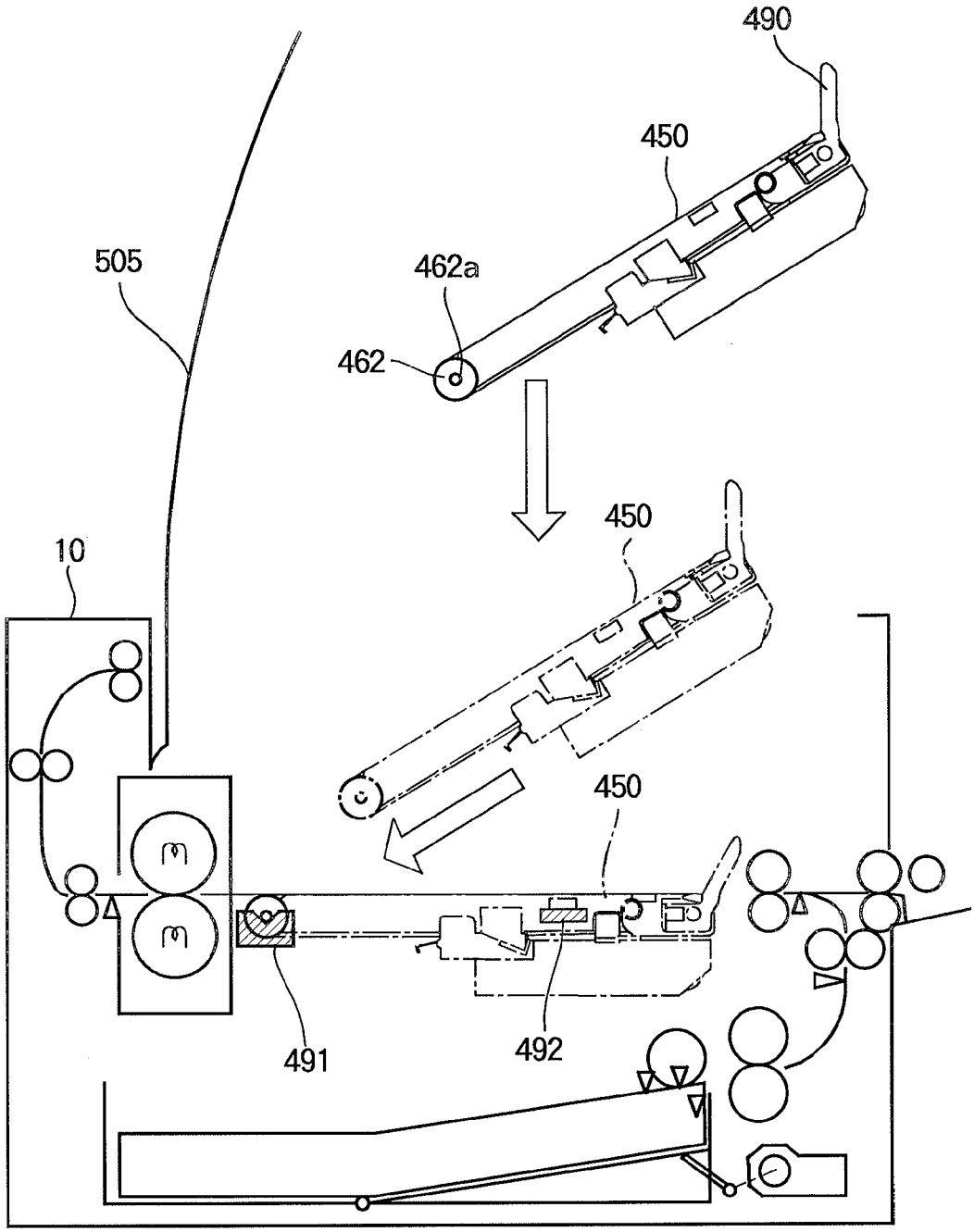
FIG. 6 is a view for illustrating a mounting operation of the transfer belt unit to the printer according to Embodiment 1.

FIG. 6 is a schematic view showing an operation for mounting the transfer belt unit 450 (i.e., the developer-adhesive body unit) to the printer 10. In FIG. 6, the transfer belt unit 450 is shown at three stages during the mounting of the transfer belt unit 450 to the printer 10. Arrows in FIG. 6 show moving directions of the transfer belt unit 450 when the transfer belt unit 450 is mounted to the printer 10. Here, the operation for mounting the transfer belt unit 450 to the printer 10 will be described with reference to FIG. 6.

The stacker portion 505 of the printer 10 is rotatably supported by a not shown shaft portion. When inserting the transfer belt unit 450, the user opens (rotates) the stacker portion 505 upward so as to expose an interior of the printer 10, and takes out the process units 430K, 430Y, 430M and 430C from the printer 10. Then, the user grips the handle portion 490 of the transfer belt unit 450, and inserts the transfer belt unit 450 into the interior of the printer 10 via an opening of the printer 10. In this state, a shaft 462*a* of the driving roller 462 of the transfer belt unit 450 engages a belt-positioning portion 491 provided in the printer 10, and a position of the driving roller 462 of the transfer belt unit 450 is determined. From this state, when the user releases the handle portion 490, the belt frame 465 of the transfer belt unit 450 contacts a belt-height determining portion 492 provided in the printer 10, and the transfer belt unit 450 is mounted to a predetermined position in the printer 10. Thereafter, the user operates a lock mechanism (not shown) to lock the transfer belt unit 450 with respect to the printer 10. In this way, the mounting of the transfer belt unit 450 to the printer 10 is completed.

When the transfer belt unit 450 is detached from the printer 10, the user grips the handle portion 490 of the transfer belt unit 450, lifts up the transfer belt unit 450, and takes out the transfer belt unit 450 from the printer 10.

Figure 7A:
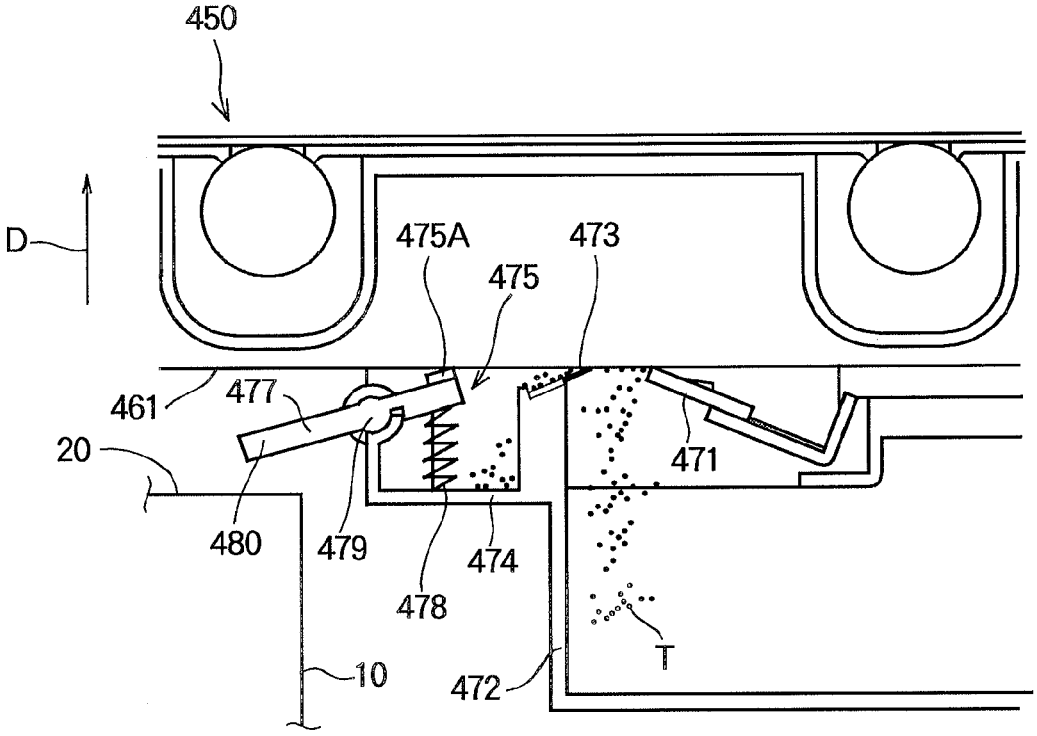
FIGS. 7A and 7B are schematic views for illustrating operations of the transfer belt unit according to Embodiment 1 when the transfer belt unit is detached from and mounted to the image forming apparatus.
Figure 7B:
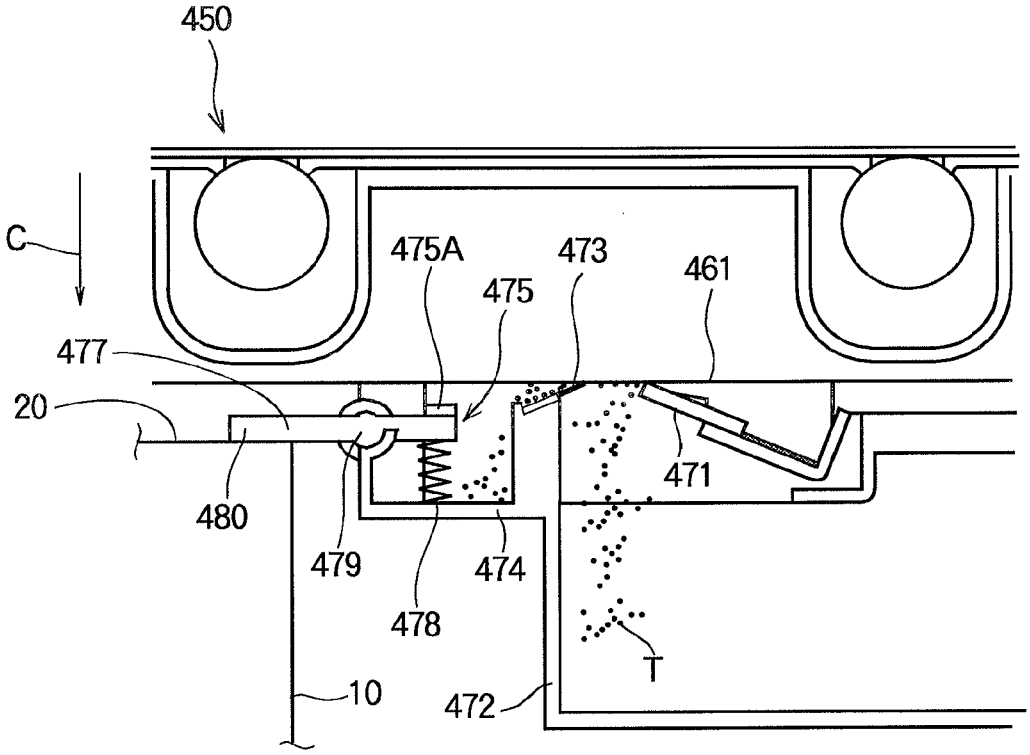

FIGS. 7A and 7B are sectional views for illustrating operations of the transfer belt unit 450 when the transfer belt unit 450 is detached from and mounted to the printer 10. FIG. 7A shows a state where the transfer belt unit 450 is detached from the printer 10, FIG. 7B shows a state where the transfer belt unit 450 is mounted to the printer 10. Hereinafter, the operation of the transfer belt unit 450 when the transfer belt unit 450 is mounted to and detached from the printer 10 will be described with reference to FIGS. 7A and 7B.

As shown in FIG. 7A, when the transfer belt unit 450 is not mounted in the printer 10, the lever 477 is pushed by the spring 478 in a direction toward the transfer belt 461 (i.e., upward in FIG. 7A), and the sponge portion 475A of the contact portion 475 is pressed against (i.e., contacts) the transfer belt 461.

As shown in FIG. 7B, when the transfer belt unit 450 is mounted to the printer 10, the transfer belt unit 450 moves in a direction shown by an arrow C. The lever actuation end 480 of the lever 477 is pushed by the lever pushing portion 20 of the printer 10, and is pushed in a direction toward the transfer belt 461 (upward in FIG. 7B). This causes the lever 477 to rotate clockwise in FIG. 7B about the rotation shaft 479, and the lever actuation end 480 moves toward the transfer belt 461. An opposite end portion of the lever 477 (where the contact portion 475 is provided) moves in a direction away from the transfer belt 461, while pressing the spring 478 downward to compress the spring 478. In this way, the sponge portion 475A separates from the transfer belt 461.

As shown in FIG. 7B, in a state where the transfer belt unit 450 is mounted to the printer 10, the sponge portion 475A is apart from the transfer belt 461. Therefore, when the transfer belt unit 450 (mounted to the printer 10) is driven and the surface of the transfer belt 461 moves, the sponge portion 475A is apart from the transfer belt 461. Therefore, the toner T adhering to the surface of the transfer belt 461 is conveyed to the cleaning blade 471 without being interfered by the sponge 475A. Then, the toner T adhering to the surface of the transfer belt 461 is scraped off from the surface of the transfer belt 461 by the cleaning blade 471, and falls into the toner box 472. The film 473 prevents the toner T (scraped off by the cleaning blade 471) from scattering outside the toner box 472. In this regard, the film 473 is not provided for scraping off the toner T, but is provided for preventing scattering of the toner T. However, there may be a case where the toner T is scraped off by the film 473. In such a case, the toner T scraped off by the film 473 is collected by the pan 474.

When the transfer belt unit 450 is detached from the printer 10, the transfer belt unit 450 moves in a direction shown by an arrow D in FIG. 7A, and the lever actuation end 480 separates from the lever pushing portion 20. Therefore, the force applied to the lever operating end 480 by the lever pushing portion 20 is released, and the lever 477 rotates counterclockwise in FIG. 7A about the rotation shaft 479 by the biasing force (i.e., the resilient restoring force) of the spring 478. The end of the lever 477 where the contact portion 475 is provided moves toward the transfer belt 461, and the lever actuation end 480 moves in a direction away from the transfer belt 461. Therefore, the sponge portion 475A contacts the transfer belt 461. In this way, when the transfer belt unit 450 is detached from the printer 10, the sponge portion 475A contacts the transfer belt 461, with the result that the toner T accumulated in the pan 474 and the toner box 472 is prevented from leaking and scattering outside.

[Advantages]

Embodiment 1 of the present invention provides the following advantages (1) through (5).

(1) In Embodiment 1, the developer-adhesive body unit includes the contact portion that contacts the developer-adhesive body at the upstream side of the cleaning member in the moving direction of the surface of the developer-adhesive body (to thereby prevent leakage of the developer stored in the developer storage portion), and the contact-and-separation unit that causes the surface of the developer-adhesive body and the contact portion to contact each other or to separate from each other. The contact-and-separation unit causes the surface of the developer-adhesive body and the contact portion to separate from each other when the developer-adhesive body unit is mounted to the image forming apparatus and the surface of the developer-adhesive body moves. The contact-and-separation unit causes the surface of the developer-adhesive body and the contact portion to contact each other when the developer-adhesive body unit is not mounted to the image forming apparatus. With such configuration, when the developer-adhesive body unit is detached from the image forming apparatus, the developer stored in the developer storage portion is prevented from leaking outside the developer-adhesive body unit. Further, when the developer-adhesive body unit is mounted to the image forming apparatus and the surface of the developer-adhesive body moves, the contact portion is not likely to scrape off the developer adhering to the surface of the developer-adhesive body.

More specifically, even when the transfer belt unit 450 is shaken or inclined during mounting or detaching of the transfer belt unit 450, the waste toner (collected from the transfer belt 461) is prevented from leaking outside the transfer belt unit 450. Further, for example, even when the transfer belt unit 450 is handled in a non-horizontal orientation, the waste toner is prevented from leaking outside the transfer belt unit 45. Thus, the user can keep its hands from becoming dirty with toner.

(2) When the developer-adhesive body unit is mounted to the image forming apparatus, the contact-and-separation unit is pushed by the image forming apparatus and is applied with a force by the image forming apparatus. The contact-and-separation unit shifts from the first state where the surface of the developer-adhesive body and the contact portion contact each other to the second state where the surface of the developer-adhesive body and the contact portion are apart from each other. When the developer-adhesive body unit is detached from the image forming apparatus, the force applied to the contact-and-separation unit by the image forming apparatus is released, and therefore the contact-and-separation mechanism returns from the second state to the first state. With such a' configuration, a contact state between the developer-adhesive body and the contact portion can be switched (based on whether the developer-adhesive body unit is mounted to the image forming apparatus or not) utilizing the force with which the contact-and-separation unit is pushed by the image forming apparatus. Therefore, the contact state between the developer-adhesive body and the contact portion can be switched with a simple configuration. For example, it is not necessary to provide an electric actuator for moving the contact portion, a sensor for detecting timings of contact and separation between the contact portion and the developer-adhesive body, a controller for controlling an actuation force, or the like.

(3) The contact-and-separation unit includes the supporting member that supports the contact portion, and the resilient member for biasing the supporting member. When the developer-adhesive body unit is mounted to the image forming apparatus, the supporting member is pushed by the image forming apparatus and is applied with the force by the image forming apparatus. With this force, the supporting member moves from the first position where the surface of the developer-adhesive body and the contact portion contact each other to the second position where the surface of the developer-adhesive body and the contact portion separate from each other. The movement of the supporting member from the first position to the second position causes the resilient deformation of the resilient member. When the developer-adhesive body unit is detached from the image forming apparatus, the force applied to the supporting member by the image forming apparatus is released, and therefore the supporting member returns from the second position to the first position by the resilient restoring force of the resilient member. With such a configuration, the contact state between the developer-adhesive body and the contact portion can be switched (based on whether the developer-adhesive body unit is mounted to the image forming apparatus or not) utilizing the force with which the supporting member pushed by the image forming apparatus and the biasing force of the resilient member. Therefore, the contact state between the developer-adhesive body and the contact portion can be switched with a simple configuration. Further, the contact portion is pressed against the developer-adhesive body by the biasing force of the resilient member, and leakage of the toner can be effectively prevented.

(4) The contact portion has the closely-contacting member that closely contacts the surface of the developer-adhesive body. With such a configuration, sealing property between the contact portion and the developer-adhesive body can be enhanced.

(5) The developer-adhesive body unit includes the seal member that contacts the developer-adhesive body at the upstream side of the cleaning member in the moving direction of the surface of the developer-adhesive body to thereby prevent scattering of the developer removed by the cleaning member, and further includes the developer holding portion provided at the upstream side of the seal member in the moving direction of the surface of the developer-adhesive body. The developer holding portion holds the developer scraped off from the developer-adhesive body by the seal member. The contact portion contacts the developer-adhesive body at the upstream side of the seal member in the moving direction of the surface of the developer-adhesive body, and prevents leakage of the developer stored in the developer storage portion and the developer held in the developer holding portion. With such a configuration, when the surface of the developer-adhesive body is moving, the developer removed by the cleaning member can be prevented from scattering outside the developer-adhesive body unit by the seal member. Further, the developer scraped off from the surface of the developer-adhesive body by the seal member can be held in the developer holding member. Furthermore, in a state where the developer-adhesive body unit is detached from the image forming apparatus, the toner held in the developer holding portion is prevented from leaking outside by the contact portion.

More specifically, the sponge portion 475A contacts the transfer belt 461, which prevents the toner (scraped off by the cleaning blade 471 and the film 473) from scattering or leaking outside the transfer belt unit 450.

Embodiment 2.

A transfer belt unit (i.e., a developer-adhesive body unit) according to Embodiment 2 of the present invention will be described. The transfer belt unit of Embodiment 2 is almost the same as that of Embodiment 1. Therefore, descriptions will be omitted or simplified regarding parts that are the same as those of Embodiment 1. Components that are the same as or correspond to those of Embodiment 1 are assigned the same reference numerals.

Figure 8:
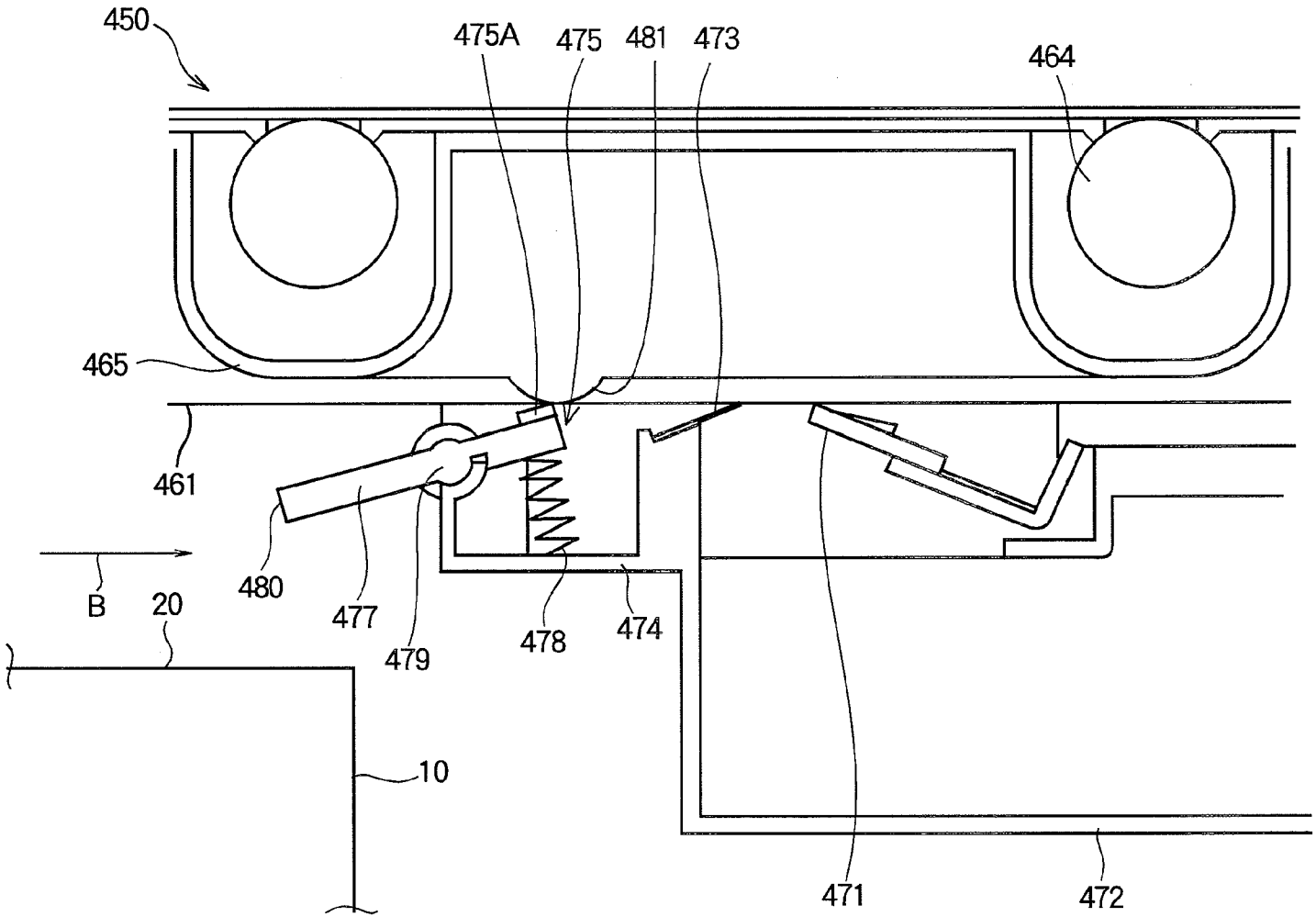
FIG. 8 is an enlarged sectional view showing a part of a transfer belt unit according to Embodiment 2 of the present invention.

FIG. 8 is an enlarged sectional view showing a part of the transfer belt unit 450 according to Embodiment 2. In FIG. 8, the transfer belt unit 450 is shown in a state where the transfer belt unit 450 is taken out from the printer 10.

As shown in FIG. 8, in Embodiment 2, the transfer belt unit 450 further includes a pressing portion 481. The pressing portion 481 is provided on a position facing the contact portion 475 via the transfer belt 461. More specifically, the pressing portion 481 is provided so as to face a surface of the transfer belt 461 opposite to a surface of the transfer belt 461 contacting the sponge portion 475A. In an example shown in FIG. 8, the pressing portion 481 is provided on the belt frame 465.

Figure 9A:
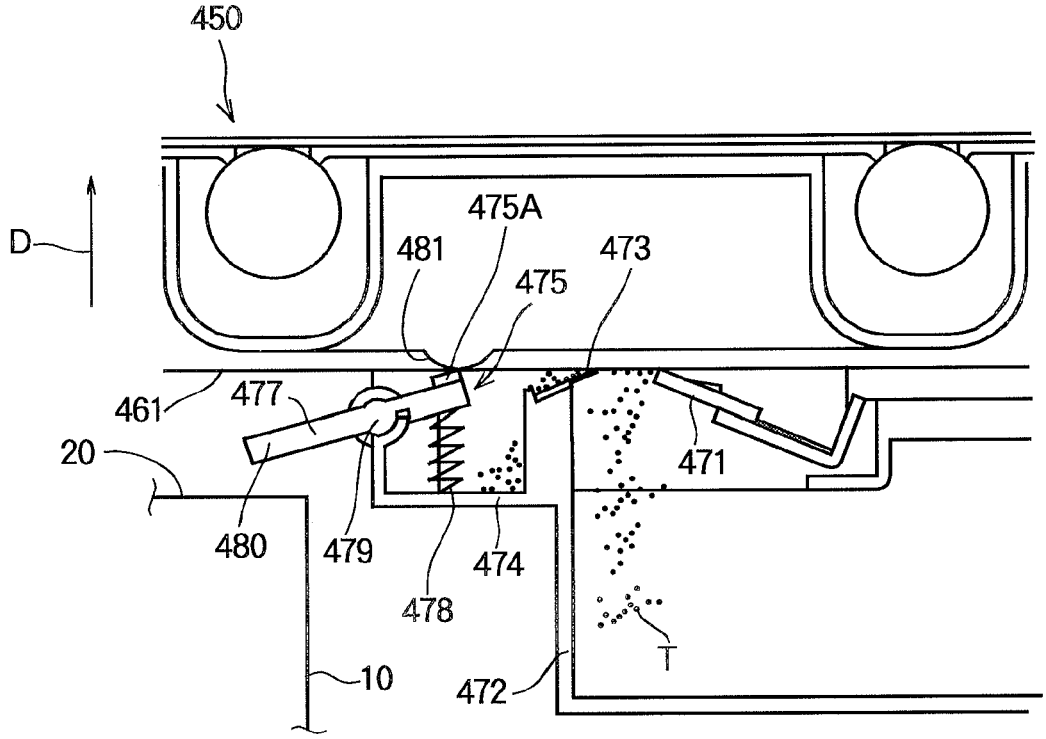
FIGS. 9A and 9B are schematic views for illustrating operations of the transfer belt unit according to Embodiment 2 when the transfer belt unit is detached from and mounted to the image forming apparatus.
Figure 9B:
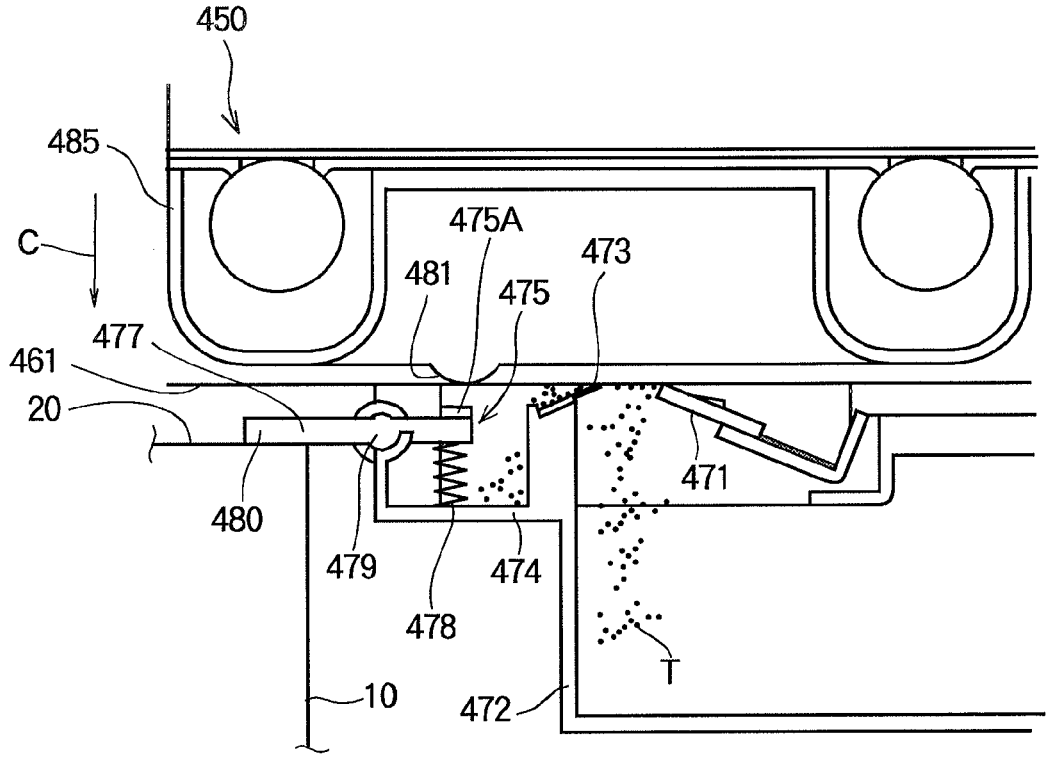

FIGS. 9A and 9B are sectional views for illustrating operations of the transfer belt unit 450 when the transfer belt unit 450 is detached from and mounted to the printer 10. FIG. 9A shows a state where the transfer belt unit 450 is detached from the printer 10, and FIG. 9B shows a state where the transfer belt unit 450 is mounted to the printer 10. The operation of the transfer belt unit 450 when the transfer belt unit 450 is mounted to or detached from the printer 10 will be described with reference to FIGS. 9A and 9B.

As shown in FIG. 9B, in a state where the transfer belt unit 450 is mounted to the printer 10, the lever actuation end 480 of the lever 477 is pushed by the lever pushing portion 20 and is applied with a force in a direction toward the transfer belt unit 450 (i.e., upward in FIG. 9B). Therefore, the sponge portion 475A is apart from the transfer belt 461.

As shown in FIG. 9A, when the transfer belt unit 450 is detached from the printer 10, the transfer belt unit 450 moves in a direction shown by an arrow D, and the lever actuation end 480 separates from the lever pushing portion 20. In this state, the force applied to the lever 477 by the lever pushing portion 20 is released. Therefore, the lever 477 rotates counterclockwise in FIG. 9A about the rotation shaft 479 by the biasing force (i.e., the resilient restoring force) of the spring 478, and the sponge portion 475A contacts the transfer belt 461. In this state, the sponge portion 475A is pressed against the pressing portion 481 via the transfer belt 461. The pressing portion 481 receives a force with which the sponge portion 475A presses the transfer belt 461, so that the pressing portion 481 and the sponge portion 475A sandwich the transfer belt 461. That is, the contact portion 475 and the pressing portion 481 sandwich the transfer belt 461 by the biasing force of the spring 478.

The above described Embodiment 2 provides the following advantages in addition to the advantages of Embodiment 1:

(6) In Embodiment 2, the developer-adhesive body unit includes a pressing portion provided so as to face the contact portion via the developer-adhesive body. The contact portion is pressed against the pressing portion via the developer-adhesive body when the surface of the developer-adhesive body and the contact portion contact each other. Therefore, according to Embodiment 2, leakage of the toner can be effectively prevented.

More specifically, the sponge portion 475A can be pressed against the transfer belt 461 with a stronger force. Therefore, a configuration in which the transfer belt 461 is sandwiched by the pressing portion 481 and the sponge portion 475A has an enhanced effect in preventing leakage of the toner. For example, even when the user pushes the surface of the transfer belt 461 on the sponge portion 475A side toward a direction away from the sponge 475A (i.e., when the user pushes the lower surface of the transfer belt 461 upward in FIG. 8), the sponge portion 475A is prevented from separating from the deformed transfer belt 461. Thus, it becomes possible to prevent leakage of the toner due to separation between the sponge portion 475A and the transfer belt 461.

The present invention is not limited to the above described embodiments, and modifications and improvements may be made to the invention.

Figure 10:
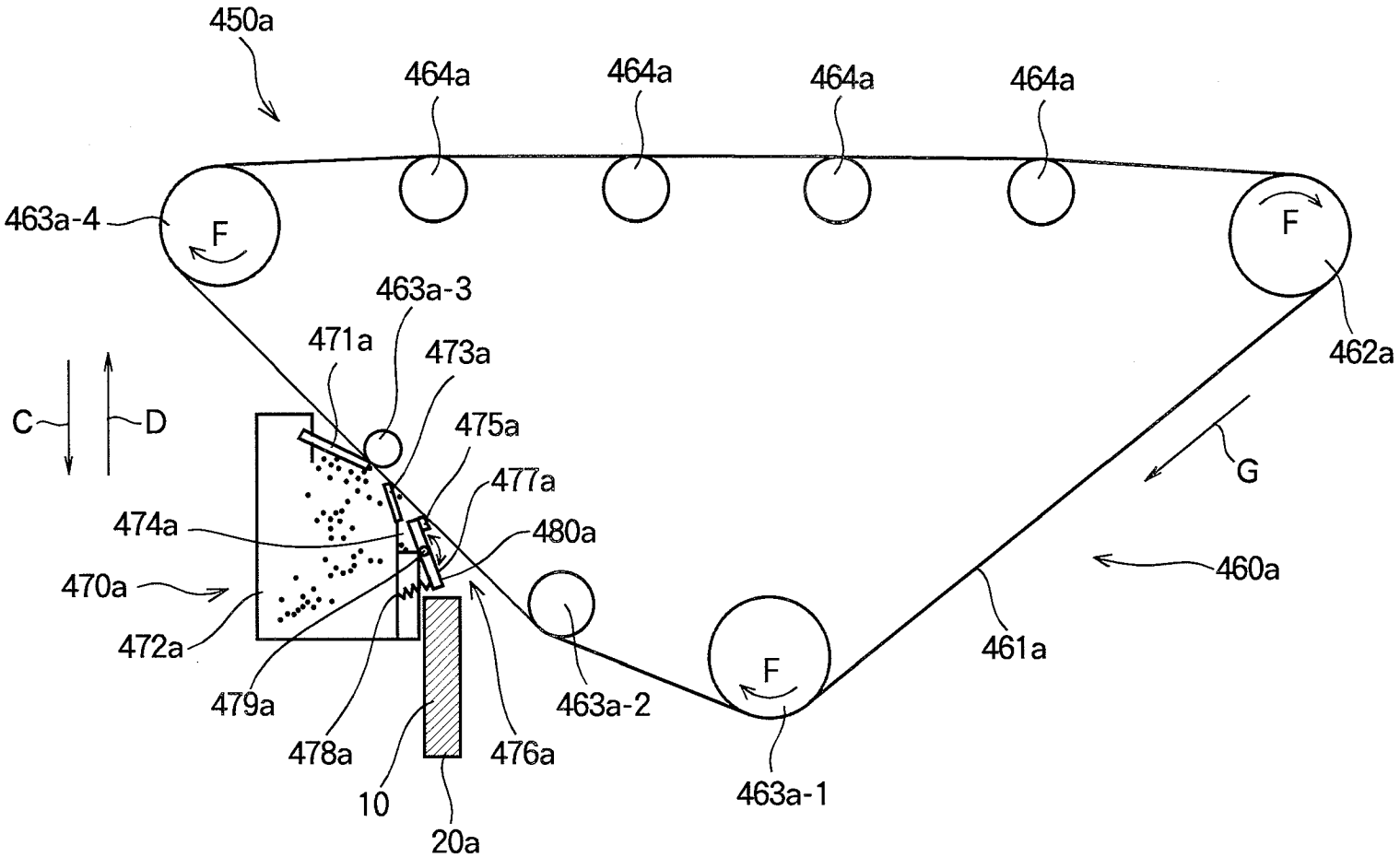
FIG. 10 is a sectional view showing a configuration of an intermediate transfer belt unit.
Figure 11:
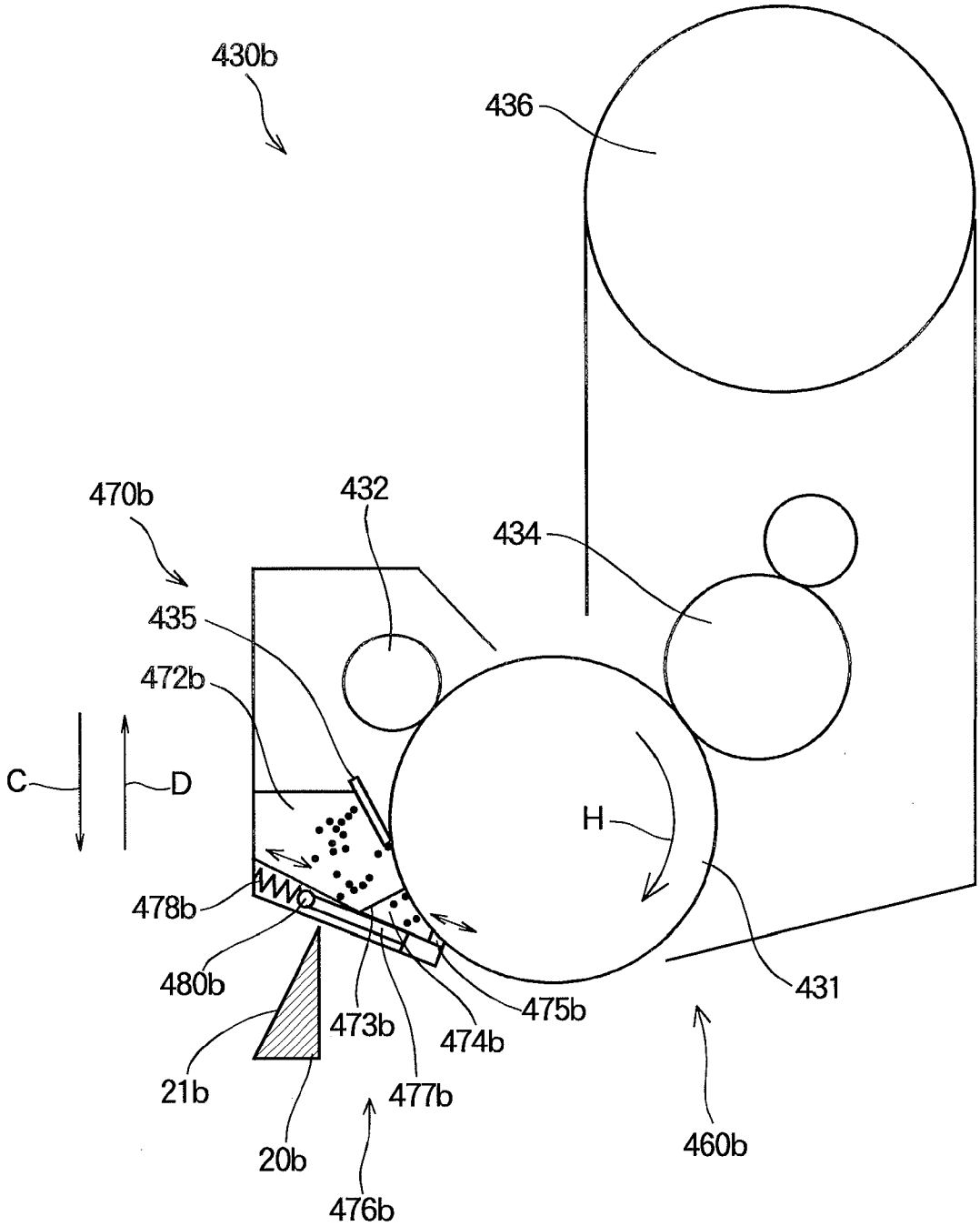
FIG. 11 is a sectional view showing a configuration of a photosensitive drum unit.

For example, in the above described embodiments, the transfer belt used in a direct transfer system (i.e., a direct transfer belt or a recording medium conveying belt) has been described as an example of the developer-adhesive body. However, the developer-adhesive body is not limited to such a transfer belt. For example, the developer-adhesive body can be a transfer belt for an intermediate transfer system (i.e., an intermediate transfer belt or a toner carrying belt), or a photosensitive body such as a photosensitive drum. FIG. 10 shows an intermediate transfer belt unit 450*a* including an intermediate transfer belt 461*a*. FIG. 11 shows a photosensitive drum unit 430*b* including the photosensitive drum 431.

The configuration of the contact-and-separation mechanism 476 is not limited to the above described examples, but can be arbitrarily modified. For example, in the above described embodiments, the lever 477 is pushed by the spring 478. However, as shown in FIG. 10, it is also possible to employ a configuration in which a lever 477*a* is pulled by a spring 478*a*. Further, in the above described embodiments, the lever 477 is configured to rotate. However, it is also possible to employ a configuration in which a lever 477*b* linearly moves as shown in FIG. 11.

Further, in the above described embodiments, the sponge has been described as an example of the closely-contacting member of the contact portion 475. However, the closely-contacting member is not limited to the sponge, but can be other material such as a resilient material (for example, rubber) capable of closely contacting the surface of the transfer belt 461. Further, if the contact portion 475 can contact the surface of the transfer belt 461 to sufficiently prevent leakage of the toner, it is also possible to eliminate the closely-contacting member.

Moreover, in the above described embodiments, the contact portion 475 prevents leakage of the toner stored in the toner box 472 and the toner held in the pan 474. However, it is only necessary that the contact portion 475 prevents leakage of the toner stored in the toner box 472. Further, in the above described embodiments, the film 473 is provided for preventing scattering of the toner scraped off by the cleaning blade 471. However, it is also possible to eliminate the film 473 and the pan 474. For example, if a distance between the cleaning blade 471 and the sponge portion 475A is sufficiently long and if a possibility that the toner scraped off by the cleaning blade 471 leaks outside the transfer belt unit 450 during the image forming operation is low, the film 473 and the pan 474 can be eliminated. In this case, the contact portion 475 contacts the transfer belt 461 so as to seal a gap between the toner box 472 and the transfer belt 461.

Furthermore, in the above described embodiments, the contact-and-separation mechanism 476 causes the contact portion 475 to contact the surface of the transfer belt 461 using the resilient force of the resilient member (i.e., the spring 478). However, it is also possible that the contact-and-separation mechanism 476 uses magnetic force or gravity instead of resilient force.

Moreover, in the above described embodiments, the contact and separation between the transfer belt 461 and the contact portion 475 are performed utilizing the force generated when the lever 477 is pushed by the lever pushing portion 20 of the printer 10. However, the contact and separation between the transfer belt 461 and the contact portion 475 can also be performed using other actuation force such as a driving force of an electric actuator or the like. For example, the printer 10 can have an actuation force imparting unit that imparts an actuation force to the contact-and-separation mechanism 476. More specifically, the printer 10 can have an electric actuator that provides an actuation force to the lever 477, instead of the lever pushing portion 20.

Furthermore, in the above described embodiments, the transfer belt 461 and the contact portion 475 separate from each other when the transfer belt unit 450 is mounted to the printer 10. However, it is also possible that the transfer belt 461 and the contact portion 475 separate from each other at other timing. For example, the printer 10 can be configured to impart an actuation force to the lever 477 to cause the contact portion 475 to separate from the transfer belt 461 at a predetermined timing (for example, a timing immediately before the driving belt 461 starts moving) after the transfer belt unit 450 is mounted to the printer 10 and before the surface of the transfer belt 461 starts moving.

Moreover, in the above described embodiments, the transfer belt 461 and the contact portion 475 contact each other when the transfer belt unit 450 is detached from the printer 10. However, it is also possible that the transfer belt 461 and the contact portion 475 contact each other at other timing. For example, the printer 10 can be configured to impart an actuation force to the lever 477 to cause the contact portion 475 and the transfer belt 461 to contact each other at a predetermined timing before the transfer belt unit 450 is detached from the printer 10, for example, a timing immediately after the movement of the driving belt 461 ends, or a timing when an opening of the stacker portion 505 is detected.

Furthermore, in the above described embodiments, images of black (K), yellow (Y), magenta (M) and cyan (C) are formed. However, the kind of colors, and the number of colors (i.e., the number of process units) can be arbitrarily modified. Further, an image forming method and positions of respective components can be arbitrarily modified. In the above described embodiments, the color printer has been described as an example of the image forming apparatus. However, the image forming apparatus can be configured as, for example, a copier, a monochrome printer, a facsimile machine and the like.

In addition, in the above described embodiments, the toner has been described as an example of the developer. However, it is also possible to use other developer.

[Intermediate Transfer Belt Unit]

Hereinafter, an intermediate transfer belt unit 450*a* (i.e., a developer-adhesive body unit) shown in FIG. 10 will be described.

In FIG. 10, the intermediate transfer belt unit 450*a* includes a belt driving unit 460*a* and a waste toner collection unit 470*a*.

The belt driving unit 460*a* includes a transfer belt 461*a*, a driving roller 462*a*, a plurality of rollers 463*a*-1, 463*a*-2, 463*a*-3 and 463*a*-4 and transfer rollers 464*a*. The transfer belt 461*a* is stretched around the driving roller 462*a* and the rollers 463*a*-1, 463*a*-2, 463*a*-3 and 463*a*-4. The transfer belt 461*a* is rotated by a rotation of the driving roller 462*a*. The driving roller 462*a* and the rollers 463*a*-1, 463*a*-2, 463*a*-3 and 463*a*-4 rotate in directions indicated by arrows F in FIG. 10, and a surface of the transfer belt 461*a* moves in a belt-moving direction indicated by an arrow G in FIG. 10. Four transfer rollers 464*a* are respectively provided so as to face corresponding photosensitive drums (not shown in FIG. 10) via the transfer belt 461*a*. The transfer rollers 464*a* transfer the toner images of the corresponding photosensitive drums to the transfer belt 461*a*.

The waste toner collection unit 470*a* is a cleaning apparatus configured to collect the toner adhering to the surface of the transfer belt 461*a*. The toner box 472*a* (i.e., a developer storage portion) stores the toner scraped off by the cleaning blade 471*a*. The film 473*a* (i.e., a seal member) contacts the surface of the transfer belt 461*a* so as to prevent the toner (scraped off by the cleaning blade 471*a*) from scattering outside the toner box 472*a*. The pan 474*a* (i.e., a developer holding portion) holds the toner scraped off from the transfer belt 461*a* by the film 473*a*.

The contact portion 475*a* is contactable with and separable from the transfer belt 461*a*. The contact portion 475*a* contacts the surface of the transfer belt 461*a* at an upstream side of the film 473*a* in the belt-moving direction so as to prevent leakage of the toner stored in the toner box 472*a* and the toner held in the pan 474*a*.

The contact-and-separation mechanism 476*a* includes a lever 477*a* (i.e., a supporting member) supporting the contact portion 475*a* and a spring 478*a* (i.e., a resilient member) for biasing the lever 477*a*. The lever 477*a* is provided at an upstream side of the film 473*a* in the belt-moving direction, and has a shape elongated in the belt-moving direction. The contact portion 475*a* is provided on the downstream end portion of the lever 477*a* in the belt-moving direction. The lever 477*a* is rotatably supported by a rotation shaft 479*a* at a position between both ends of the lever 477*a* in the belt-moving direction. The rotation shaft 479*a* is parallel to the surface of the transfer belt 461*a* and is perpendicular to the belt-moving direction. The lever 477*a* is biased by the spring 478*a* so as to rotate about the rotation shaft 479*a* in a direction in which the contact portion 475*a* moves toward the transfer belt 461*a*. More specifically, the spring 478*a* is configured to pull an upstream end portion of the lever 477*a* in the belt-moving direction so that the upstream end portion of the lever 477*a* moves away from the transfer belt 461*a*. The upstream end portion of the lever 477*a* in the belt-moving direction constitutes a lever actuation end 480*a* that receives an actuation force for moving the contact portion 475*a*. A lever pushing portion 20*a* is provided in the printer 10. The lever pushing portion 20*a* pushes the lever actuation end 480*a*. The lever actuation end 480*a* is applied with the actuation force by the lever pushing portion 20*a*.

During the image forming operation, the surface of the transfer belt 461*a* moves in the direction shown by the arrow G in FIG. 10. Toner images of four colors are transferred to the surface of the transfer belt 461 by the transfer rollers 464*a* as primary transfer rollers. The toner image transferred to the conveying belt 461*a* is conveyed to the roller 463*a*-1 according to movement of the surface of the transfer belt 461*a*. The roller 463*a*-1 and a secondary transfer roller (not shown) form a nip, at which the toner image is transferred from the transfer belt 461*a* to the surface of the recording medium.

Next, an operation of the intermediate transfer belt unit 450*a* when the intermediate transfer belt unit 450*a* is mounted to or detached from the printer 10 will be described.

As shown in FIG. 10, in a state where the intermediate transfer belt unit 450*a* is not mounted to the printer 10, the lever 477*a* is biased by the spring 478*a*, and the contact portion 475*a* is in contact with the transfer belt 461*a*.

When the intermediate transfer belt unit 450*a* is mounted to the printer 10, the intermediate transfer belt unit 450*a* moves in a direction shown by an arrow C in FIG. 10, and the lever actuation end 480*a* of the lever 477*a* is pushed by the lever pushing portion 20*a* of the printer 10. The lever actuation end 480*a* is applied with a force in a direction (i.e., an upward direction) toward the transfer belt 461*a*. Therefore, the lever 477*a* rotates counterclockwise in FIG. 10 about the rotation shaft 479*a*, and the lever actuation end 480*a* moves in a direction toward the transfer belt 461*a*. An opposite end portion of the lever 477*a* where the contact portion 475*a* is provided moves in a direction away from the transfer belt 461*a*. The spring 478*a* is pulled by the lever 477*a* and extends. Therefore, the contact portion 475*a* separates from the transfer belt 461*a*.

When the intermediate transfer belt unit 450*a* is detached from the printer 10, the intermediate transfer belt unit 450*a* moves in a direction shown by an arrow D, and the lever actuation end 480*a* separates from the lever pushing portion 20*a*. In this state, the force applied to the lever 477*a* by the lever pushing portion 20*a* is released. Therefore, the lever 477*a* rotates clockwise in FIG. 10 about the rotation shaft 479*a* by the biasing force (i.e., the resilient restoring force) of the spring 478*a*. The end portion of the lever 477*a* where the contact portion 475*a* is provided moves in a direction toward the transfer belt 461*a*, and the lever actuation end 480*a* moves in a direction away from the transfer belt 461*a*. Thus, the contact portion 475*a* contacts the transfer belt 461*a*.

[Photosensitive Drum Unit]

Hereinafter, a photosensitive drum unit 430*b* (i.e., a developer-adhesive body unit) shown in FIG. 11 will be described.

The photosensitive drum unit 430*b* shown in FIG. 11 has almost the same configuration as the process unit described in Embodiment 1 and 2. For example, the photosensitive drum unit 430*b* is used as the process unit in Embodiment 1 and 2. Descriptions will be omitted or simplified regarding parts that are the same as those of Embodiment 1 or 2. Components that are the same as or correspond to those of Embodiment 1 or 2 are assigned the same reference numerals.

In FIG. 11, the photosensitive drum unit 430*b* includes a drum driving unit 460*b* and a waste toner collection unit 470*b*.

The drum driving unit 460*b* includes a photosensitive drum 431 that rotates in a direction shown by an arrow H, a charging roller 432, a developing roller 434 and a toner storage portion 436.

The waste toner collection unit 470*b* is a cleaning apparatus configured to collect the toner adhering to the surface of the photosensitive drum 431. The waste toner collection unit 470*b* includes a cleaning blade 435, a toner box 472*b*, a film 473*b*, a pan 474*b*, a contact portion 475*b* and a contact-and-separation mechanism 476*b*.

The cleaning blade 435 (i.e., a cleaning member) scrapes off a non-transferred toner remaining on the surface of the photosensitive drum 431. The toner box 472*b* (i.e., a developer storage portion) stores the toner scraped off by the cleaning blade 435. The film 473*b* (i.e., a seal member) contacts the surface of the photosensitive drum 431 so as to prevent the toner (scraped off by the cleaning blade 435) from scattering outside the toner box 472*b*. The pan 474*b* (i.e., a developer holding portion) holds the toner scraped off from the photosensitive drum 431 by the film 473*b*.

The contact portion 475*b* is contactable with or separable from the photosensitive drum 341. The contact portion 475*b* contacts the surface of the photosensitive drum 431 at an upstream side of the film 473*b* in a moving direction of a surface of the photosensitive drum 431 (hereinafter referred to as a drum-moving direction) to prevent leakage of the toner stored in the toner box 472 and pan 474*b*.

The contact-and-separation mechanism 476*b* includes a lever 477*b* supporting the contact portion 475*b*, and a spring 478*b* for biasing the lever 477*b*. The lever 477*b* (i.e., a supporting member) has a shape extending toward the photosensitive drum 431. The contact portion 435*b* is provided on an end portion of the lever 477*b* facing the photosensitive drum 431. The lever 477*b* is provided so as to be linearly movable in a direction toward and away from the photosensitive drum 431. The lever 477*b* is biased by the spring 478*b* (i.e., a resilient member) in a direction toward the photosensitive drum 431. More specifically, the spring 478*b* biases a lever actuation end 480*b* of the lever 477*b* toward the photosensitive drum 431. The lever actuation end 480*b* is provided on an end portion of the lever 477*b* opposite to the end portion facing the photosensitive drum 431.

Next, operations of the photosensitive drum unit 430*b* when the photosensitive drum unit 430*b* is mounted to or detached from the printer 10 will be described.

As shown in FIG. 11, in a state where the photosensitive drum unit 430*b* is not mounted to the printer 10, the lever 477*b* is biased in a direction toward the photosensitive drum 431, and the contact portion 475*b* contacts the photosensitive drum 431.

When the photosensitive drum unit 430*b* is mounted to the printer 10, the photosensitive drum unit 430*b* moves in a direction indicated by an arrow C (referred to as a mounting direction), and the lever actuation end 480*b* of the lever 477*b* is pushed by the lever pushing portion 20*b* of the printer 10. The lever pushing portion 20*b* has an inclined surface 21*b* having an inclination such that a distance from the photosensitive drum 431 increases along the mounting direction C. The lever actuation end 480*b* contacts the inclined surface 21*b*. Therefore, as the photosensitive drum unit 430*b* moves in the mounting direction C, the lever actuation end 480*b* is guided along the inclined surface 21*b* and moves in a direction away from the photosensitive drum 431 while compressing the spring 478*b*. Thus, the contact portion 475*b*'separates from the photosensitive drum 431.

When the photosensitive drum unit 430*b* is detached from the printer 10, the photosensitive drum unit 430*b* moves in a direction shown by an arrow D (referred to as a detaching direction), and the lever actuation end 480*b* is applied with a biasing force (i.e., a resilient restoring force) by the spring 478*b*. Therefore, the lever actuation end 480*b* is guided along the inclined surface 21*b* and moves in a direction toward the photosensitive drum 431. Thus, as shown in FIG. 11, the lever actuation end 480*b* separates from the inclined surface 21*b*, and the contact portion 475*b* contacts the surface of the photosensitive drum 431.

While the preferred embodiments of the present invention have been illustrated in detail, it should be apparent that modifications and improvements may be made to the invention without departing from the spirit and scope of the invention as described in the following claims.

What is claimed is:

1. A developer-adhesive body unit detachably mounted to an image forming apparatus, said developer-adhesive body unit comprising:

a developer-adhesive body having a surface to which a developer adheres;

a cleaning member that removes said developer from said surface of said developer-adhesive body;

a developer storage portion for storing said developer removed by said cleaning member;

a contact portion that contacts said surface of said developer-adhesive body at an upstream side of said cleaning member in a moving direction of said surface of said developer-adhesive body, and a contact-and-separation unit that causes said surface of said developer-adhesive body and said contact portion to contact each other or to separate from each other, a seal member that contacts a surface of said developer-adhesive body at an upstream side of said cleaning member in said moving direction of said surface of said developer-adhesive body, and a developer holding portion provided at an upstream side of said seal member in said moving direction of said surface of said developer-adhesive body, said developer holding portion holding said developer removed from said surface of said developer-adhesive body by said seal member; and wherein said contact-and-separation unit causes said surface of said developer-adhesive body and said contact portion to separate from each other when said developer-adhesive body unit is mounted to said image forming apparatus and said surface of said developer-adhesive body moves, and causes said surface of said developer-adhesive body and said contact portion to contact each other when said developer-adhesive body unit is not mounted to said image forming apparatus.

2. The developer-adhesive body unit according to claim 1, wherein said contact-and-separation unit comprises:

a supporting member on which said contact portion is provided, and a resilient member that biases said supporting member in a direction in which said contact portion contacts said developer-adhesive body.

3. The developer-adhesive body unit according to claim 2, wherein, when said developer-adhesive body unit is mounted to said image forming apparatus, said supporting member moves from a first position to a second position while causing said resilient member to resiliently deform;

wherein, when said developer-adhesive body unit is detached from said image forming apparatus, said supporting member moves from said second position to said first position by a resilient restoring force of said resilient member, and wherein said first position is a position where said contact portion contacts said developer-adhesive body, and said second position is a position where said contact portion separates from said developer-adhesive body.

4. The developer-adhesive body unit according to claim 2, wherein said supporting member includes a rotation shaft, and said supporting member rotates about said rotation shaft.

5. The developer-adhesive body unit according to claim 4, wherein, when said developer-adhesive body unit is mounted to said image forming apparatus, said supporting member rotates in a direction in which said contact portion separates from said developer-adhesive body while causing said resilient member to resiliently deform, and wherein, when said developer-adhesive body unit is detached from said image forming apparatus, said supporting member rotates in a direction in which said contact portion is pushed against said developer-adhesive body by a resilient restoring force of said resilient member.

6. The developer-adhesive body unit according to claim 4, wherein said contact portion includes a closely-contacting member that closely contacts said developer-adhesive body.

7. The developer-adhesive body unit according to claim 1, wherein said contact portion includes a closely-contacting member that closely contacts said developer-adhesive body.

8. The developer-adhesive body unit according to claim 1, wherein said contact portion includes a sponge portion that closely contacts said developer-adhesive body.

9. The developer-adhesive body unit according to claim 1, wherein said contact portion is provided at an upstream side of said developer holding portion in said moving direction of said surface of said developer-adhesive body.

10. The developer-adhesive body unit according to claim 1, wherein said developer-adhesive body is in the form of a belt.

11. The developer-adhesive body unit according to claim 1, further comprising a pressing portion provided so as to face said contact portion via said developer-adhesive body.

12. An image forming apparatus comprising said developer-adhesive body unit according to claim 1.

13. The image forming apparatus according to claim 12, further comprising a pushing portion;

wherein, when said supporting member is pushed by said pushing portion, said supporting member moves from a first position to a second position while causing a resilient member to resiliently deform;

wherein, when said supporting member separates from said pushing portion, said supporting member moves from said second position to said first position by a resilient restoring force of said resilient member, and wherein said first position is a position where said contact portion contacts said surface of said developer-adhesive body, and said second position is a position where said contact portion separates from said surface of said developer-adhesive body.

14. The image forming apparatus according to claim 13, wherein said contact portion is provided on an end of said supporting member, and said pushing portion pushes the other end of said supporting member.

* * * * *